US009933137B2

(12) United States Patent
Kjeldsen et al.

(10) Patent No.: US 9,933,137 B2
(45) Date of Patent: Apr. 3, 2018

(54) PROJECTING LIGHT FIXTURE WITH DYNAMIC ILLUMINATION OF BEAM SHAPING OBJECT

(71) Applicant: Martin Professional ApS, Aarhus N (DK)

(72) Inventors: Jesper Kjeldsen, Silkeborg (DK); Matthias Hinrichs, Prior Lake, MN (US)

(73) Assignee: Martin Professional APS, Aarhus N (DK)

( * ) Notice: Subject to any disclaimer, the term of this patent is extended or adjusted under 35 U.S.C. 154(b) by 309 days.

(21) Appl. No.: 14/843,671

(22) Filed: Sep. 2, 2015

(65) Prior Publication Data

US 2016/0069540 A1 Mar. 10, 2016

(30) Foreign Application Priority Data

Sep. 4, 2014 (DK) ..... 2014 70541

(51) Int. Cl.
*F21V 14/06* (2006.01)
*H05B 37/02* (2006.01)
(Continued)

(52) U.S. Cl.
CPC ..... *F21V 14/06* (2013.01); *F21S 10/00* (2013.01); *F21S 10/007* (2013.01); *F21V 5/008* (2013.01);
(Continued)

(58) Field of Classification Search
CPC ..... F21S 10/007; F21S 10/00; F21V 14/08; F21V 14/085; F21V 5/00; F21W 131/406; F21Y 101/02; H05B 33/08
See application file for complete search history.

(56) References Cited

U.S. PATENT DOCUMENTS 8,757,809 B2 * 6/2014 Jorgensen ..... G03B 33/06 353/30
9,651,222 B2 * 5/2017 Jorgensen ..... F21V 14/04
(Continued)

FOREIGN PATENT DOCUMENTS

CN 1611827 A 5/2005
CN 1712766 A 12/2005
(Continued)

OTHER PUBLICATIONS

European Search Report for corresponding Application No. 15183206.0, dated Nov. 25, 2015, 16 pages.
Danish Office Action and Search Report for corresponding Application No. PA 2014 70541, dated Mar. 18, 2015, 6 pages.

*Primary Examiner* — William C Dowling
(74) *Attorney, Agent, or Firm* — Brooks Kushman P.C.

(57) ABSTRACT

The present invention relates to a projecting light fixture comprising a light source module comprising a plurality of light sources and a plurality of light collectors, where the light collectors collect light from the light sources and convert the collected light into a plurality of source light beams. The source light beams are concentrated at an optical gate where a beam shaping object is arranged and a projecting system is configured to project light passing through the beam shaping object along a primary optical axis. The light sources and light collectors are arrange in a plurality of groups each providing an illumination of the beam shaping object where the illuminations of the beam shaping object are different. The light fixture comprises a controller configure to vary the intensity of the different illuminations in relation to each other whereby a large number of new light effects can be provided.

19 Claims, 16 Drawing Sheets

(51) Int. Cl.

| | |
|---|---|
| ***F21S 10/00*** | (2006.01) |
| ***F21V 5/02*** | (2006.01) |
| ***F21V 14/08*** | (2006.01) |
| ***F21V 5/00*** | (2015.01) |
| ***F21V 13/12*** | (2006.01) |
| *H05B 33/08* | (2006.01) |
| *F21W 131/406* | (2006.01) |
| *F21Y 105/10* | (2016.01) |
| *F21Y 115/10* | (2016.01) |
| *F21Y 113/13* | (2016.01) |

(52) U.S. Cl.

CPC ..... *F21V 5/02* (2013.01); *F21V 13/12* (2013.01); *F21V 14/08* (2013.01); *H05B 33/0803* (2013.01); *F21V 5/007* (2013.01); *F21W 2131/406* (2013.01); *F21Y 2105/10* (2016.08); *F21Y 2113/13* (2016.08); *F21Y 2115/10* (2016.08); *H05B 33/0845* (2013.01)

(56) References Cited

U.S. PATENT DOCUMENTS

| | | | | |
|---|---|---|---|---|
| 2002/0181231 | A1 | 12/2002 | Luk | |
| 2010/0097802 | A1* | 4/2010 | Jurik | G02B 27/0994 362/235 |
| 2010/0149494 | A1 | 6/2010 | Kawachi et al. | |
| 2010/0204841 | A1 | 8/2010 | Chemel et al. | |
| 2012/0320102 | A1* | 12/2012 | Jorgensen | F21S 10/007 345/690 |
| 2013/0135856 | A1 | 5/2013 | Arai | |
| 2014/0185285 | A1 | 7/2014 | Jorgensen | |
| 2014/0232992 | A1 | 8/2014 | Egawa | |

FOREIGN PATENT DOCUMENTS

| | | | |
|---|---|---|---|
| JP | 2005158699 | A | 6/2005 |
| JP | 2006040872 | A | 2/2006 |
| WO | 2013060329 | A1 | 5/2013 |
| WO | 2013091654 | A1 | 6/2013 |

* cited by examiner

PROJECTING LIGHT FIXTURE WITH DYNAMIC ILLUMINATION OF BEAM SHAPING OBJECT

CROSS-REFERENCE TO RELATED APPLICATIONS

This application claims priority to DK Application No. PA 2014 70541 filed 4 Sep. 2014, the disclosure of which is hereby incorporated in its entirety by reference herein.

TECHNICAL FIELD

The present invention relates to a projecting light fixture where an optical gate is illuminated by a light source module and where a projecting system is configured to project the light passing through the optical gate along a primary optical axis. A beam shaping object is arranged near the optical gate and is configured to modify the light beam.

BACKGROUND

In order to create various light effects and mood lighting in connection with concerts, live shows, TV shows, sport events or as a part of an architectural installation light fixtures creating various light effects are getting more and more used in the entertainment industry. Typically, entertainment light fixtures create a light beam having a beam width and a divergence and can for instance be wash/flood light fixtures creating a relatively wide light beam or it can be projecting fixtures configured to projecting images onto a target surface.

Projecting light fixtures comprises an optical gate illuminated by a light source module and an optical projecting system is configured to collect light passing through the optical gate along a primary optical axis. A beam shaping object is often arranged at the optical gate and is used to shape the light beam. The beam shaping object can be used to create midair effects (visible due to light scattering in/on smoke/haze in the air) where the shape of the light beam in midair is defined by the beam shaping object and/or the beam shaping object can create a light pattern which is projected to and imaged on a target surface. The beam shaping object can be any object capable of the modifying the light beam and can for instance be GOBOs, Animation wheels, frost filters, color filters, prisms, framing blades, iris, textured glass, etc. The beam shaping objects can be used as static objects arranged in the light beam and/or as movable objects which are moved in relation to the light beam in order to create a dynamic light effect. Additionally, it is known to use a digital imaging device such as DMDs, LCDs or the like as beam shaping objects whereby the projected light beam can be used as a digital projector, for instance in order to project graphical images and/video signals.

Light designers and programmers want as many effects as possible in a lighting apparatus as this gives the light designer and programmers many options when creating light shows. However, it is difficult to provide lighting apparatus with many effects as each kind of the light effect components take up space in the lighting apparatus. Especially, it is difficult to provide many light effects in projecting light devices as the light forming element need to be positioned in a focal point (the optical gate) of the optical system, and typical optical systems are only capable of focusing in a very limited area. At the same time, it is also desired to have light and compact light fixtures as these are easier to handle.

Additionally, light designers and programmers also want new light effects which can be used to create light shows.

SUMMARY

The objective of the present invention is to provide a compact projecting light fixture capable of creating new light effects. This can be achieved by a projecting light fixture as defined by the independent claims. The benefits and advantages of the present invention are disclosed in the detailed description of the drawings illustrating the invention. The dependent claims define different embodiments of the invention.

DETAILED DESCRIPTION

The present invention is described in view of exemplary embodiments only intended to illustrate the principles of the present invention. The skilled person will be able to provide several embodiments within the scope of the claims. In the illustrated embodiments the illustrated light beams and optical components do only serve to illustrate the principles of the invention rather than illustrating exact and precise light beams and optical components. Throughout the description the reference numbers of similar elements providing similar effects have been given the same last two digits.

Figure 1:
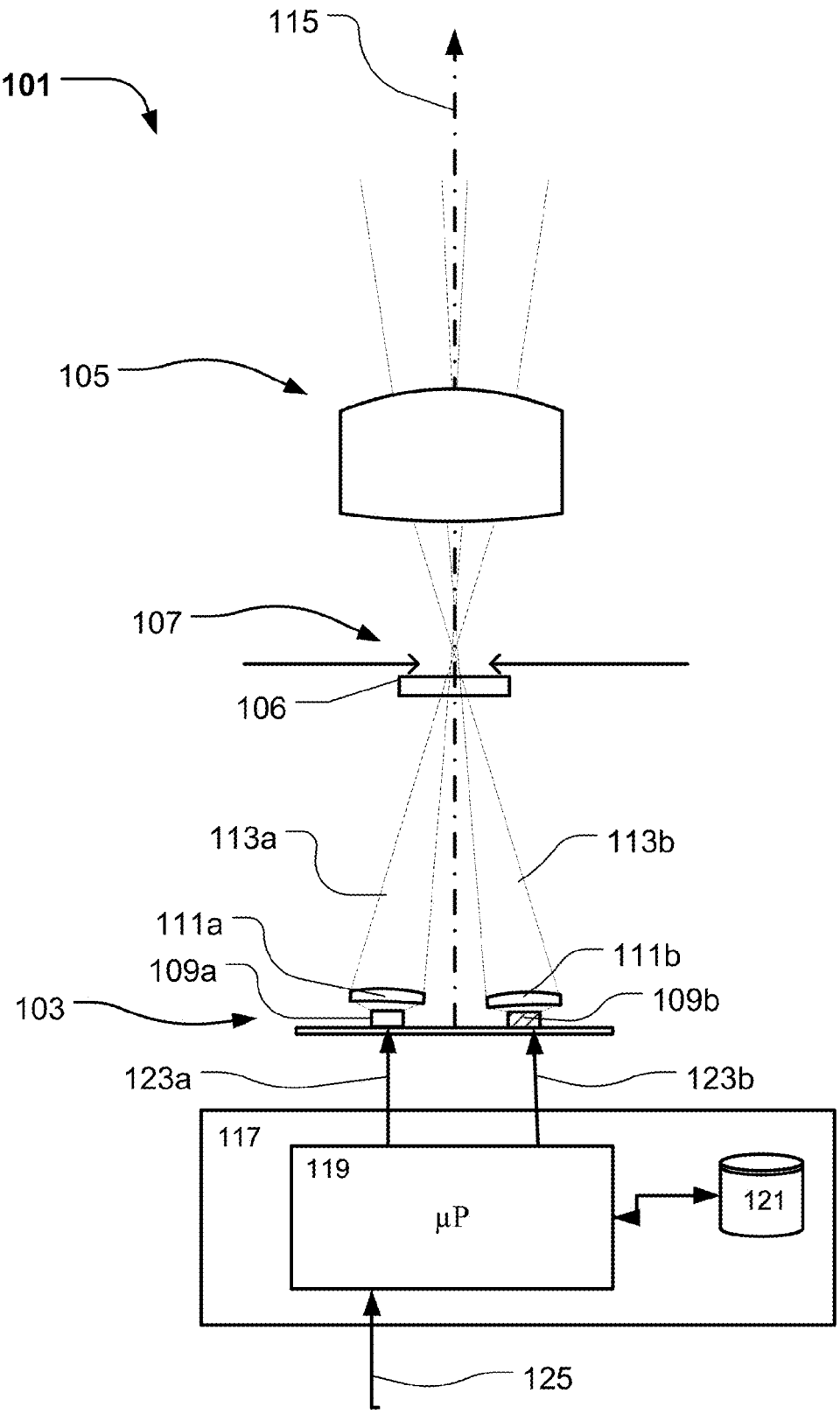
FIG. 1 illustrates a structural diagram of a projection light fixture according to the present invention.

FIG. 1 illustrates a structural diagram of a projection light fixture 101 according to the present invention. The light fixture comprises a light source module 103, a projecting system 105 and an optical gate 107 arranged between the light source module 103 and the projecting system 105. The optical gate defines an area where the light source module 103 is configured to concentrate and focused the source light beams. In the illustrated embodiment, the optical gate 107 is indicated as an aperture, however it to be understood that the physical aperture can be omitted and that the beam shaping device also can constitute an aperture. At least one beam shaping object 106, such as gobos, animation wheels, frost filters, framing blades, an iris, color filters or prisms can be arranged near the optical gate. That the beam shaping object is arranged near the optical gate means that the beam shaping object is arranged in the focal area of the light beams. The focal areas constitute the range along the primary optical axis where the light beams are concentrated. The beam shaping object 106 is configured to modify the light passing through the beam shaping object. The projecting system comprises a positive number of optical components and the projecting system is configured to collect light modified by the beam shaping object and project the light collected along the primary optical axis. The projecting system can be configured to adjust the beam width and/or divergence of the light beam exiting the projecting system and can be adjusted to image a beam shaping object arranged near the optical gate at a target surface. Additionally, the projecting device can comprise an optical zoom group and/or an optical focus group. The optical zoom group comprises at least one optical component and is configured to adjust the divergence and/or width of the light beam. The optical focus group comprises at least one optical component and is configured to focus the image of the beam shaping object at a target surface along the primary optical axis. The projecting system can also be provided as a fixed group of optical components having a predefined focusing and zoo properties. The at least one optical component of the optical zoom group and/or the optical focus group can be any optical component known in the art of optical such as lenses, prisms, reflectors, etc. It is further noticed the some of the optical components can be movable in relation to the primary optical axis.

The light source module 105 comprises a plurality of light sources 109*a*, 109*b* and a plurality of light collectors 111*a*, 111*b*. Each light collector is configured to collect light from at least one of the light sources and convert the collected light into a source light beam 113*a*, 113*b* and the source light beam propagate along a primary optical axis 115 (illustrated in dashed dotted line). As a consequence a plurality of source light beams are created and propagate along the primary optical axis 115.

The plurality of light sources and the plurality of light collectors are arranged in a first group and in a second group, where each group comprises at least one light source and at least one light collector. Each group provides thus at least one source light beam. In the illustrated embodiment the first group comprises at least one first light source 109*a* and at least one first light collector 111*a*, where the first light collector 111*a* collects light from the first light source 109*a* and converts the collected light into a first source light beam 113*a* (illustrated in dashed lines). The first source light beam propagates along the primary optical axis and provides a first illumination of the optical gate. That the first source light beam provides a first illumination of the optical gate means that the first source light beam propagates through at least a part of the optical gate.

Similar the second group comprises at least one second light source 109*b* and at least one second light collector 111*b*, where the second light collector 111*b* collects light from the second light source 109*b* and converts the collected light into a second source light beam 113*b* (illustrated in dotted lines). The second source light beam 113*b* propagates along the primary optical axis and provides a second illumination of the optical gate. The second source light beam 113*b* provides a second illumination of the optical gate means that the second source light beam 113*b* propagates through at least a part of the optical gate.

In the illustrated embodiment, each of the first and the second groups comprise one light source and one light collector collecting light from the light source. However, as shown in the later figures, it is to be understood that each group can comprise any positive number of light sources and any positive number of light collectors. Additionally, it is to be understood that each light collector can be configured to collect light from any positive number of light sources and the light collector can thus be adapted to collect light from a single light source or a plurality of light sources.

In the illustrated embodiment, the first and second light sources are LEDs (Light emitting diodes), however the skilled person realizes that any kind of controllable light sources can be used, such as OLED (organic light emitting diodes), PLED (polymer light emitting diodes), discharge lamps, incandescent lamps, plasma lamps.

The projecting light fixture 101 comprises a controller 117 configured to control the first light source (or group of light sources) and the second light source (or group of light sources) individually. The controller comprises a processor 119 and a memory 121. The processor 119 is configured to control the first group of light sources 109*a* and the second group of light sources 109*b*, respectively, through communication lines 123*a* and 123*b*. The processor 119 can thus control one of the groups of light sources without controlling the other group of light sources. The processor 119 can for instance be adapted to control the color and/or intensity of the light sources and can be based on any type of communication signals known in the art of lightning, e.g., PWM, AM, FM, binary signals, etc. The first and second group of light sources 109*a*, 109*b*, respectively, can thus be controlled individually and independently and can thus be treated as two individually and independently groups of light sources. It is to be understood that the individually light sources of each groups can be controlled by the same control signal, supplied with individual control signals and/or grouped in sub-groups where each subgroup receive the same control signal. The communication lines 123*a* and 123*b* are illustrated as individual communication lines to the first group and to the second group where the controller 117 is configured to generate the activation signal for each light source. However, the skilled person will be able to provide many kinds of communication means between the controller and the light sources for instance by providing a driver which generates the activation signals for the light sources based on a control signal from the controller. Both groups of light sources can be connected to the same data bus and controlled by the controller through a data bus using addressing. In embodiments where the first group and/or the second group comprises a plurality of light sources, it is to be understood that the light sources of each group can be controlled based on the same control signal from the controller or controlled by the same driver.

The controller 117 can be adapted to control the first group and the second group based on respectively a first light source control parameter and a second light source control parameter. The first light source control parameter and the second light source control parameter are indicative of at least one parameter defining how the first group and the second group should be controlled. The light source parameter can for instance be indicative of intensity/dimming of the light source, the storing frequency etc.

The controller 117 can obtain the first and second light source parameters from the memory 121 in form of a preprogrammed pattern/light show. In one embodiment the controller is configured to receive the first light source parameter and the second light source parameter from an input signal 125 received from an external source. The input signal 125 can be any signal capable of communication of parameters and can for instance be based on one of the following protocols USITT DMX 512, USITT DMX 512 1990, USITT DMX 512-A, DMX-512-A including RDM as covered by ANSI E1.11 and ANSI E1.20 standards, Wireless DMX, Artnet or ACN designates Architecture for Control Networks; ANSI E1.17, E1.31. The light source control parameters can also be generated from user input means either implemented as a part of the projecting light fixture or implemented on an external controller which sends the light source control parameter to the projecting light fixture through an input signal.

The first illumination provided by the first group and the second illumination provided by the second group are different. For instance in that the first and second source light beams have different angles in relation to the primary optical axes at the optical gate, that the first source light beams and second source light beams illuminates different areas at the optical gate, that the first and second source light beams provides different light distributions at the optical gate.

By arranging the light sources into a first group and a second group which illuminate the optical gate differently and at the same time providing a controller capable of controlling the first and second group individually makes it possible to provide a large number of light effects. The light effects are provided by controlling the first group and the second group individually and thereby also control the illumination of the beam shaping object, as different illumination of the beam shaping object results in different light patterns being projected by the projecting system. As a consequence, different light patterns can be provided by controlling which group of light sources that are illuminating the optical gate. For instance, when illuminating the beam shaping object using the first group a first light pattern is created and when illuminating the beam shaping object using the second group, a second light pattern is created. Additionally, a combination of the first light pattern and the second light pattern can be provided by illuminating the beam shaping object using both the first group and the second group. A large number of combinations of the first light patterns and the second light patterns can be provided by varying the intensity of the first group and the second group in relation to each other. In an embodiment where the first group and/or second group comprises color tunable light sources (e.g., RGB 3 in LEDs or RGBW 4 in one LEDs), the combination of the first light pattern and the second light pattern can also be provided by controlling the color of the first group and the color of the second group in relation to each other. As will be described in connection with other embodiments, the light effects can also be provided in combination with other light modifying components which are configured to modify the light beam, such as prism effects, zoom/focus, animation wheels, color filters, iris, framing modules etc. The intensity of the different illuminations can be varied in relation to each other by controlling the intensity of the first light source and the second light sources in relation to each other, for instance, by alternately turning the first light source and the second light source on and off, by varying the intensity of the first and second light source using various of intensity functions e.g. sine functions, predefined dimming patterns, sawtooth functions, random functions etc.

The first illumination and the second illumination can be different in that the angle between the primary optical axis and the at least one first source light beam and the angle between the primary optical axes and the at least one second source light beam are different. This result in the fact that the first light beam pattern created by the first group and beam shaping object and the second light beam pattern created by the second group and beam shaping object will be displaced in relation to each other when exiting the projecting light fixture. For instance, if the projecting system images a gobo arranged near the optical gate at a target surface results in the fact that the image created using the first group and the image created using the second group are offset each other at the target surface. It is noticed that the images may partially overlap. In one embodiment where the first group and the second group comprises a plurality of light sources and light collectors and each group provides a plurality of source light beams, it is possible that some of the first source light beams and some of the second light source beams has the same angle in relation to the primary optical axis. As a consequence, it is to be understood that the first illumination and the second illumination may differ if only one of the first light source beams has an angle in relation to the primary axis which is different from the second source light beams angles in relation to the primary optical axis.

In one embodiment, the first group and the second group have been arranged such that the angle between the primary optical axis and the first source light beam is smaller than a lower angle limit and such that the angle between the primary optical axis and the second source light beam is larger than the lower angle limit. This can be achieved by arranging the first group closer to the primary optical axis in relation the second group. Variations of such embodiments are shown in FIG. 4*a*-4*d*.

The first illumination and the second illumination can be different in that at least one of the first light source beam and at least one of the second light source beams illuminates different areas of the optical gate. This result in the fact that the illumination of different parts of the optical gate can be provided and it is thus possible to control which part of the beam shaping object that are illuminated. For instance, if the projecting system images a gobo arranged near the optical gate at a target surface different part of the image can be controlled by controlling the first group and the second group in relation to each other. This can for instance be used to provide light effects with dynamic change of different part of the image.

The first illumination and the second illumination can be different in that a first light distribution provided by the at least one first source light beam at the beam shaping object and a second light distribution provided by the at least one second source light beam at the beam shaping object are different. The first light distribution at the beam shaping object provided by the at least one first source light beam(s) defines the light density across the beam shaping object meaning the light intensity across the beam shaping object. Similar second light distribution at the beam shaping object provided by the at least one second source light beam(s) defines the light density across the beam shaping object meaning the light intensity across the optical gate.

Figures 2A, 2B:
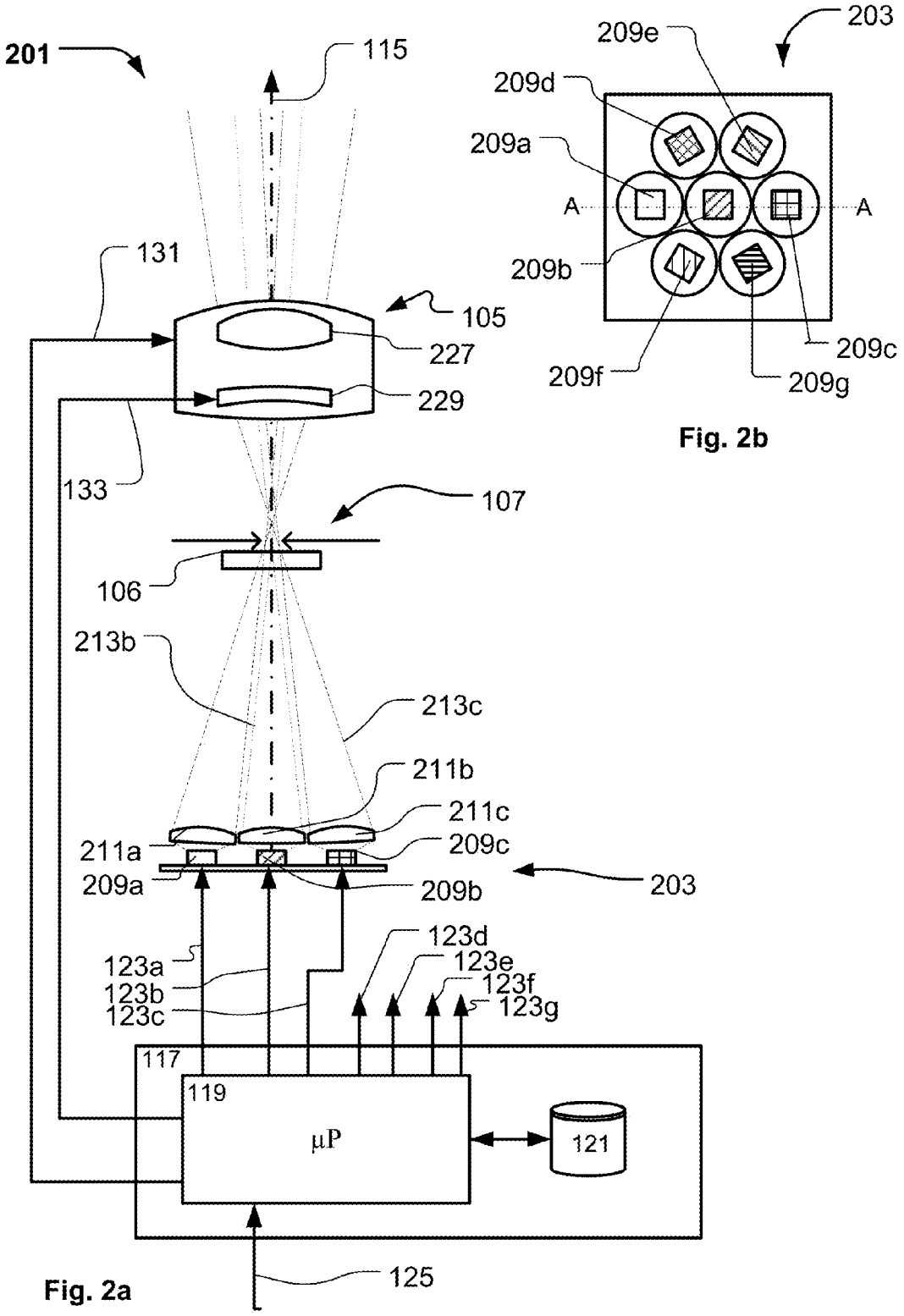
FIGS. 2*a* and 2*b* illustrate a structural diagram of another embodiment of a projecting light fixture according to the present invention.

FIG. 2*a* illustrates a structural diagram of a projection light fixture 201 according to the present invention and FIG. 2*b* illustrates a front view of the light source module 203 as seen from the optical gate 207. The part of the structural diagram in FIG. 2*a* illustrating the light source module 203, the optical gate 107, the beam shaping device 106 and the projecting system 105 corresponds to a cross sectional view through line A-A indicated in FIG. 2*b*. FIG. 2*a* and FIG. 2*b* serve to illustrate further features of the projecting light fixture according to the present invention.

The projecting light fixture 201 are similar to the projecting light fixture 101 illustrated in FIG. 1 and similar features as been labeled with the same reference numbers and will not be described in further details. The projecting light fixture 201 comprises a light source module 203, a projecting system 105 and an optical gate 107 arranged between the light source module 203 and the projecting system 105. At least one beam shaping object 106 such as gobos, animation wheels, frost filters, framing blades, an iris, color filters, prisms etc. is arranged near the optical gate. The beam shaping device is configured to modify the light near the optical gate.

Like the light source module 103 of FIG. 1, the light source module 203 comprises a plurality of light sources 209*a*-209*g* and a plurality of light collectors 211*a*-211*g*. In this embodiment, the plurality of light sources and light collectors are arranged in seven groups, where each group comprises at least one light source and at least one light collector and each group provides at least one source light beam 213*a*-213*c* (the source light beams of the $4^{th}$ to $7^{th}$ groups are not shown).

The at least one source light beams of each group propagate along the primary optical axis and provides an illumination of the beam shaping device near the optical gate. The plurality of the light sources and light collectors are configured such that the seven illuminations of the optical gate are different. The seven illuminations can differ from each other in way as described in connection with FIG. 1. As a consequence, in the illustrated embodiment, the light source module can provide seven different illuminations at the optical gate and the seven different illuminations can be controlled by the controller 117. A large number of light effects can hereby be provided, as each of the seven illuminations of the beam shaping object provides different light patterns which can be used to generate light effects. Additionally, further dynamic light effects can be created as the seven illuminations of the beam shaping device can be controlled in a huge number ways in relation to each other, for instance by alternately turning the seven illuminations on/off, by combining any number of the illumination, dimming any of the illuminations in relation to each other. Additionally, in embodiments where color the color of the different illuminations can be varied in relation to each other is also possibly to vary the color of the light patterns. This can for instance by done if the light sources are implemented as 4 in 1 RGBW LEDs or 3 in 1 RBW LEDs where the LED comprises LED dies of different colors.

In FIG. 2*b*, the light sources belonging to the same group have been given the same fill/hatching and it can be seen that each group comprises one light source and one corresponding light collector, however it is to be understood that each group can comprise any positive number of light sources and light collectors and FIGS. 2*a* and 2*b* primarily serve to illustrate the possibility that the light sources and light collector can be arranged in more than two groups. In other embodiments, the groups of light sources and light collectors can comprise more than one light source and corresponding light collector such that each group provides more the one source light beam. For instance, in the illustrated embodiment, light sources 209*a*-209*c* and corresponding light collectors 211*a*-211*c* may be grouped as a first group where the light sources 209*a*-209*c* are controlled identically; light sources 209*d*-209*e* and corresponding light collectors 211*d*-211*e* may be grouped as a second group where the light sources 209*d*-209*e* are controlled identically and the light sources 209*f*-209*g* and corresponding light collectors 211*f*-211*g* may be grouped as a third group where the light sources 209*f*-209*g* are controlled identically.

The projecting system 105 is configured to collect light modified by the beam shaping object 106 and project the light along the primary optical axis 115. In this embodiment, the projecting system comprises an optical zoom group 227 and an optical focus group 229.

The optical zoom group 227 comprises at least one optical component which is movable along the primary optical axis in order to adjust the divergence and/or width of the light beam. The controller 117 is further configured to control the position of the optical zoom group along the primary optical axis through communication line 131. For instance, the optical zoom group can be moved by and actuator that is controlled by the controller. The optical focus group 229 comprises at least one optical component and is movable along the primary optical axis and is configured to focus an image of the beam shaping object at a target surface along the primary optical axis. The controller 117 is further configured to control the position of the optical focus group along the primary optical axis through communication line 133. For instance, the optical focus group can be moved by and actuator that is controlled by the controller.

The controller can be configured to control the optical zoom group based on a first zoom level parameter, where the first zoom level parameter is indicative of the zoom level of the projected light beam. The zoom level parameter can be obtained from the memory 121, from an input signal 125 or from a user interface. The controller can also be configured to control the optical focus group based on a focus parameter. The focus parameter can be indicative of the distance where the image of the beam shaping object shall be focused, be determined based on the zoom level parameter and/or indicate if a defocused image are to be provided. The controller can further be configured to determine the focus level parameter based on the zoom level parameter, e.g., in order to maintain the same focusing during a zoom operation. In one embodiment, the optical focus group is movable between a focusing position and a de-focusing position, where in the focusing position the optical focus group is configured to image the beam shaping object at a target surface along the primary optical axis and where in the de-focusing position the optical focus group is configured to provide a defocused image of the beam shaping object. This result in the effect that a blurred image of the projected light pattern can be provided which results in a further light effect option which can be used in connection with the different light patterns provided by controlling the different groups individually.

Figure 3:
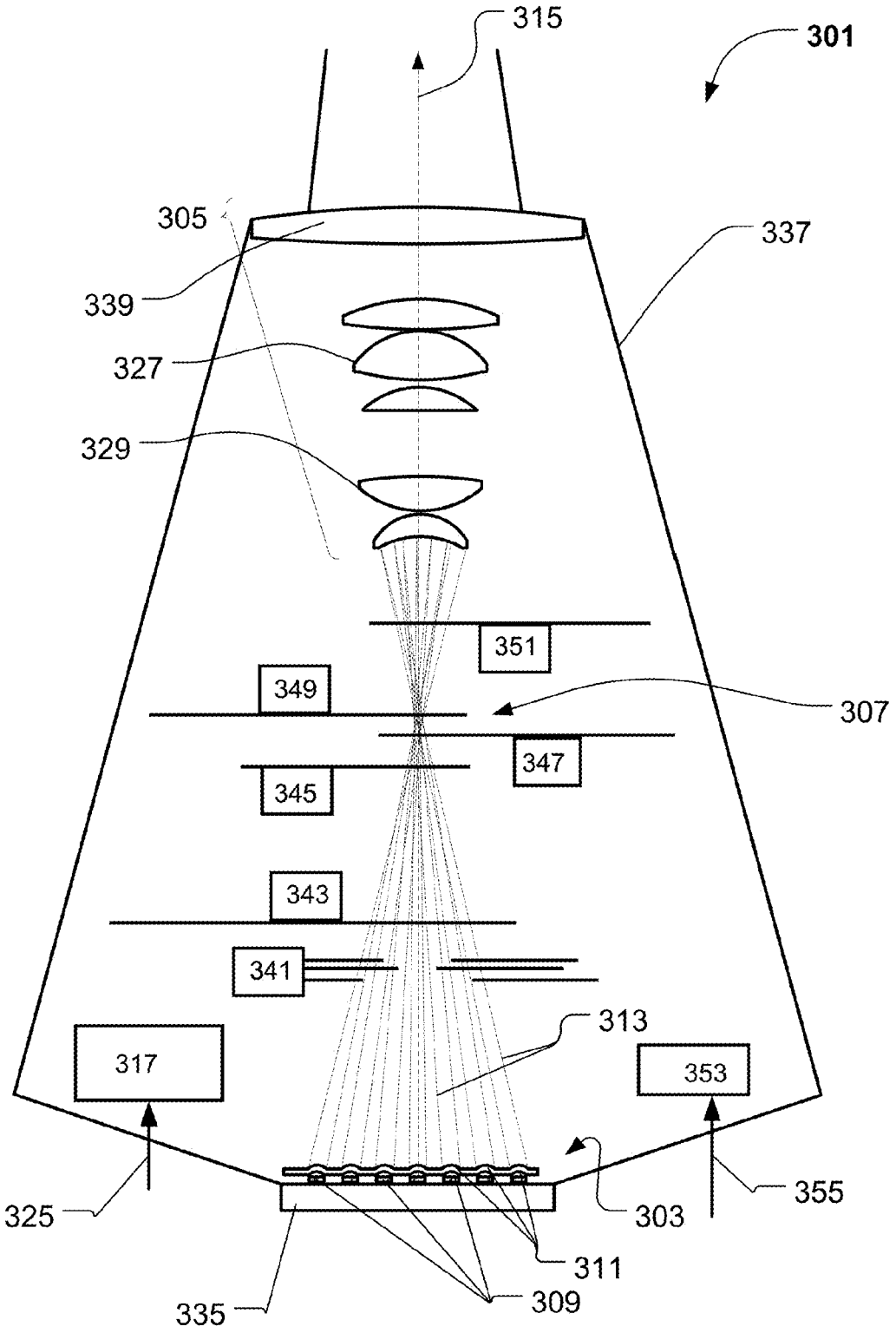
FIG. 3 illustrates a structural diagram of another embodiment of a projecting light fixture according to the present invention.

FIG. 3 illustrates a structural diagram of a projecting light fixture 301 according to the present invention. The projecting light fixture 301 comprises the same basic components as the projecting light fixtures illustrated in FIGS. 1 and 2*a* and similar elements providing similar effects have in FIG. 3 been given the same last two digits and will not be described in detail.

The light fixture comprises a plurality of light sources 309 formed as LEDs arranged on a heat sink 335, a plurality of light collectors 311, an optical gate 307 and an projecting system 305. The light sources and heat sink are arranged at the bottom part of a lamp housing 337 of the light fixture and the other components are arranged inside the lamp housing 337. The light collectors 311 are configured to collect light from the LEDs 309 and to convert the collected light into a plurality of source light beams 313 (dotted lines) propagating along the optical axis 315. In the illustrated embodiment, the light collector comprises a number of lenslets each collecting light from one of the LEDs and converting the light into a corresponding source light beam. However, it is noticed that the light collector also can be embodied as a single optical lens, a Fresnel lens, a number of total reflection lenses ("TIR") lenses, a number of light rods etc. or combinations thereof. It is understood that light beams propagating along the optical axis contain rays of light propagating at an angle, e.g. an angle less that 45 degrees to the optical axis.

As described previously, the projecting system 305 is configured to collect at least a part of the light beams transmitted through the optical gate and to project the light along the primary optical axis and may be configured to image the optical gate 307 onto some object such as a screen, e.g. a screen or an area on a concert stage. A certain image, e.g., some opaque pattern provided on a transparent window, an open pattern in a non-transparent material, or imaging object such as gobos known in the field of entertainment lighting, may be arranged near the optical gate 307 so that the illuminated image can be imaged by the optical projecting system. Accordingly, the light fixture 301 may be used for entertainment lighting.

In the illustrated embodiment, the light is directed along the optical axis 315 by the light collector 311 and passes through a number of light effect components before exiting the light fixture through a front lens 339. The light effects components creates various light effects and can for instance be any light effects components known in the art of intelligent/entertainments lighting. The light effects components can for instance be, a CMY color mixing system 341, color filters 343, gobos 345, animation effects 347, a iris diaphragm 349, prism effect 351, an optical focus group 329, an optical zoom group 327, a framing effects (not shown), or any other light effect components known in the art of entertainment lighting. The light effect components and light modifying components arranged near the optical gate 307 are throughout this application referred to as beam shaping objects, as these light effect components typical are used to provide some beam shaping of the light beam and the projecting system is configured to image the beam shaping objects along the optical axis. The mentioned light effect components only serves to illustrate the principles of an illuminating device for entertainment lighting and the person skilled in the art of entertainment lighting will be able to construct other variations with additional are less light effect components. Further, it is noticed that the order and positions of the light effect components can be changed.

Figure 4A:
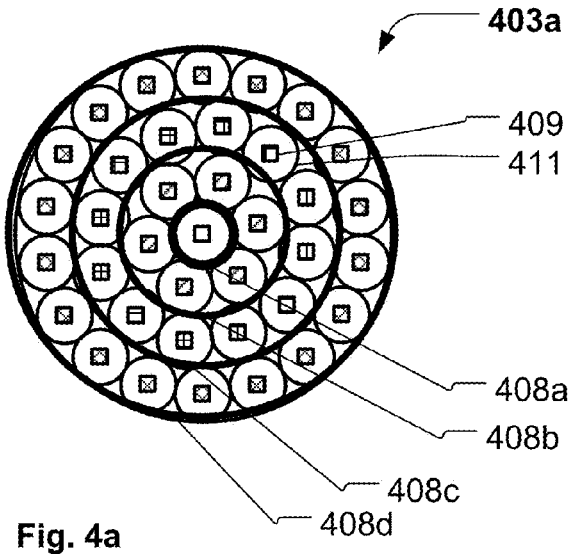
FIGS. 4*a*-4*d* illustrate possible arrangement of light sources and light collectors of a projecting light fixture according to the present invention.
Figure 4B:
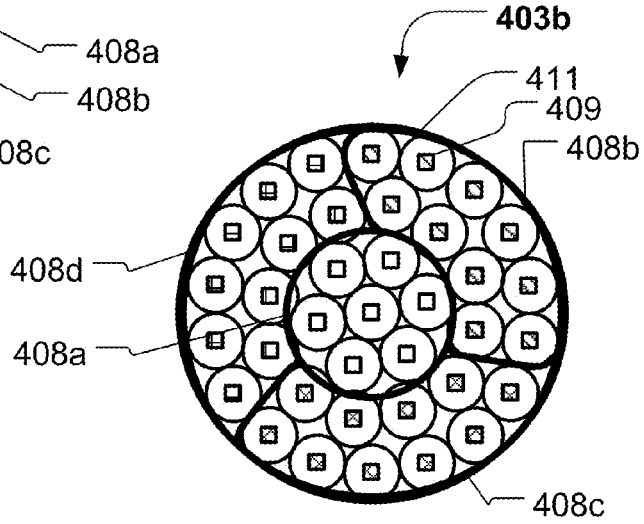
Figure 4C:
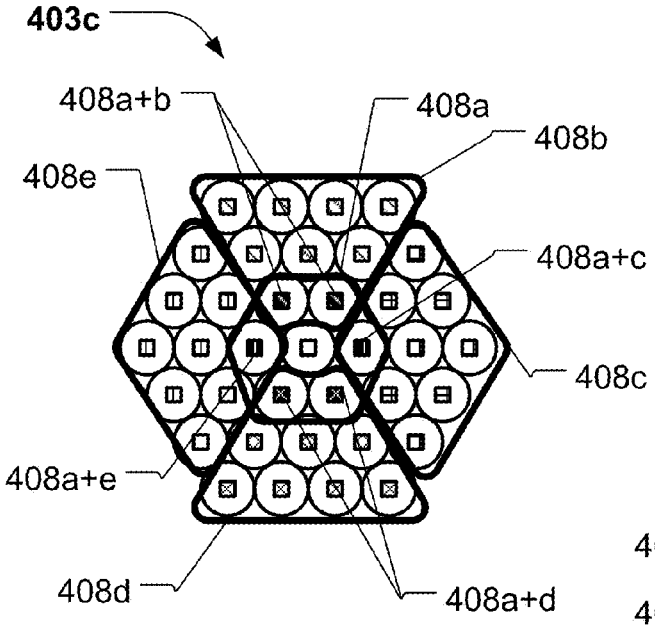

Like the light source modules described in connection with FIGS. 1 and 2, the plurality of light sources and light collectors are arranged in a plurality of groups where each group comprises at least one light source and at least one light collector and provides at least one source light beam 313. The different groups provide a different illumination of the optical gate. FIGS. 4*a*-4*c* illustrate different ways of grouping the light sources and the light collectors.

Facing FIGS. 4*a*-4*d* illustrating front views (seen from the optical gate) of different embodiments of light source modules 403*a-d* which can be used in the projecting light fixture of FIG. 3. The light source module comprises a plurality of light sources 409 (only one labeled but illustrated as quadrangles) with corresponding light collectors 411 (only one labeled but illustrated as circles).

In FIG. 4*a*, the light sources and light collectors are arranged in circular patterns and in a first group 408*a*, a second group 408*b*, a third group 408*c* and a fourth group 408*d*. The extent of the four groups has been illustrated by thick solid circles and light sources from the same group have the same hatching. The first group 408*a* comprises the central light source and the central light collector and is surrounded by the second group 408*b* comprising 6 light sources and corresponding light collector arranged in a circle around the first group. The third group comprises 12 light sources and corresponding light collectors and is arranged in a ring around the first group and the second group. Finally, the fourth group 408*d* comprises 18 light sources and corresponding light collectors arranged in a ring around the first, second and third groups. This setup makes it possible to insert light modifiers partially into the source light beams such that the light modifier is hit by source light beam from certain groups and the light effect provided by the light modifier can be applied to some of the groups. For instance, a light modifier can be inserted into the light such that it only is hit by source light beams from the fourth group when inserted from the side of the light beam.

In FIG. 4*b*, the light sources and light collectors are arranged in a circular pattern and in a first group 408*a*, a second group 408*b*, a third group 408*c* and a fourth group 408*d*. The extent of the four groups has been illustrated by thick solid lines and light sources from the same group have the same hatching. The first group 408*a* comprises the seven central light sources and corresponding light collectors. The first group 408*a* is partially surrounded by each of the second group 408*b*, third group 408*c* and the fourth group 408*d*. Each of the second group 408*b*, third group 408*c* and fourth group 408*d* surrounds approximately one third of the first group and comprises 10 light sources and corresponding light collectors. This set up makes it possible to create four images of the beam shaping object which at the target surface is offset in relation to each other. For instance, the first group can provide a central image and the second, third and fourth groups can provide offset images of the beam shaping object. This is achieved as the first group provides source light beams which are symmetrical around the primary optical axis and the second, third and fourth group provide source light beams which are arrange asymmetrically in relation to the primary optical axis, which result in the fact that the images provided by the second, third and fourth group will be offset in relation to the two optical axis.

In FIG. 4*c*, the light sources and light collectors are arranged in a hexagonal pattern and in a first group 408*a*, a second group 408*b*, a third group 408*c*, a fourth group 408*d* and a fifth group 408*e*. The extent of the five groups has been illustrated by thick solid lines and light sources from the same group have the same hatching. Similar advantages as described in connection with FIG. 4*b* are achieved; however an additionally group has been provided which adds an extra effect option. In addition, some of the light sources belongs to two different groups and can thus be activated together with both groups. Light sources which belong to two different groups have been given different inverse hatching. This is the case for light sources 409*a+b* which form part of both the first and second group; light source 409*a+c* form a part of the first and third group, light sources 409*a+d* which form part of the first and fourth group and light source 409*a+e* which form part of both the first and fifth group. In embodiments where at least two different groups share light sources, the user can be provided with the option of choosing which group the light source should belong to when the light fixtures is used and also be provided the option of choosing the groups during operation of the light fixture. Additionally or alternatively, the controller can be configured to provide a predefined prioritizing of which of the two groups the common light sources follows. For instance, the first group can be treated as the most important where the common light sources follows the first group when the first group is active and thus only follow the other group when the first group in inactive (turned off). The common light source can also be configured to follow the group having instructed to have the brightest intensity or smallest intensity.

Figure 4D:
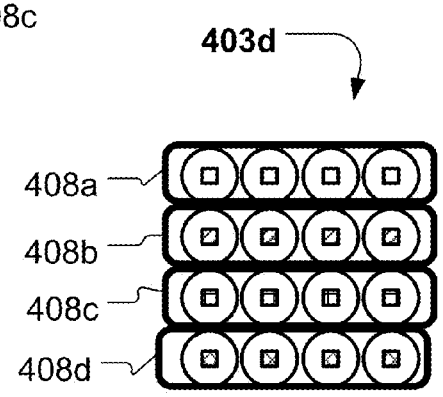

In FIG. 4*d*, the light sources and light collectors are arranged in a 4×4 pattern and in a first group 408*a*, a second group 408*b*, a third group 408*c* and a fourth group 408*d*. The extent of the four groups has been illustrated by thick solid lines and light sources from the same group have the same hatching. In this embodiment, the four groups are defined as a row in the 4×4 pattern. This makes it possible to make a dynamic light effect which moves from the top to the bottom or the opposite direction. It is to be understood that the groups also can be defined as columns in the 4×4 pattern, and that any number of row and columns can be provided.

It is to be understood that the light source modules illustrated in FIGS. 4*a-d* only serve as illustrating the principles of arranging the light sources in groups and that many other combinations, number, shapes and forms of the light source groups can be provided.

Returning to FIG. 3, the projecting light fixture 301 comprises at least one controller 317 configured to control the plurality of groups of light sources and light collectors individually as described previously. Additionally, the controller 317 is configured to control the light effect components in the light fixture as known in the art of intelligent lighting, e.g., by controlling how the CMY flags of the CMY color mixing system 341 is inserted into the light beam, controlling which color filters 343 are to be arranged in the light beam, controlling gobos 345 and the movement of the gobos in the light beam, controlling speed and direction of rotation of the animation effect wheel 347, controlling size of iris diaphragm 349, controlling the position of framing blades within the light beam, etc. The controller 317 can control the light effect components based on at least one light effect parameter received from an input signal 325, from a user interface or from a program stored in a memory. Typically, the light effect parameter is indicative of at least one light effect parameter related to the different light effects in the light system. The controller 317 is configured to send commands and instructions to the different subsystems of the projecting light fixture through internal communication lines (not shown). The internal communication system can be based on various types of communications networks/systems. It is also noticed that the controller 317 can be embodied as more than one controller. The projecting light fixture receives electrical power 355 from an external power supply (not shown). The electrical power is received by an internal power supply 353 which adapts and distributes electrical power through internal power lines (not shown) to the subsystems of the moving head. The internal power system can be constructed in many different ways for instance by connecting all subsystems to the same power line. The skilled person will however realize that some of the subsystems in the projecting light fixture need different kind of power and that a ground line also can be used. The light source will for instance in most applications need a different kind of power than step motors for moving mechanical components and driver circuits. The projecting light fixture can also comprise a user interface (not shown) enabling a user to interact directly with the projecting light fixture alternatively or in addition to using a light controller to communicate with the light fixture. The user interface can for instance comprise bottoms, joysticks, touch pads, keyboard, mouse, displays, touch screen, etc.

In one embodiment, the projecting light fixture comprises at least one light modifying component which is movable in relation to the source light beams and can be arranged in the source light beams in a partial position. In the partial position, the light modifying component is arranged at least partially in the source light beams from at least one of the groups of light sources and light collectors and is at the same time arranged outside the source light beams from at least one of the other groups of light sources and light collectors. The light modifying components will thus modify the source light beams from at least one group of light sources and light collectors while not modifying the source light beams from another group of light sources and light collectors. As a result, it is possible to apply the light modifying component to the source light beams from at least one of the groups while not applying the light modifying component to source light beam from another one of the groups. The controller can control the groups individually and thus toggle between a light effect where the light modifying component is applied to the first source light beams and not to the second source light beams. That the light modifying component is arranged outside the source light beams from one of the groups of light sources and light collectors means that at a maximum 10% of the total amount of light hitting the light modifying component originates the source light beams intended to be outside the light modifying component. It is thus to be understood that due to practical reasons, a small amount of light from the source light beams outside the light modifying component may hit the light modifying in the partial position. However, at least 90% of the light hitting the light modifying component must originate from source light beams designed to hit the light modifying component in the partial position.

For instance, an embodiment where the light sources and light collectors are arranged in a first group and in a second group, the light modifying component is thus in the partial position arranged at least partially in the first source light beams and outside the second source light beams.

The light modifying component which can be arranged partially in the source light beams can for instance be beam shaping objects like gobos, animation wheels, framing blades, textured glass etc. and the light effect crated by the beam shaping object can thus be applied to the source light beams from one group of light sources and not to another group of light sources. The modifying component can also be color filtering components for instance a color flag which can be arranged partially in the source light beams. It is also possible to provide two light modifying components which can be arranged partially in the source light beams, for instance such that a first of the light modifying components is arranged in the source light beams from a first group while a second of the light modifying component is arranged in the source light beams from a second group.

For instance, in the illustrated projecting light fixture illustrated in FIG. 3, the CMY flags 341 can be arranged partially in the source light beam whereby it is possible to apply the color filtering effect to the outer part of the source light beams and in embodiments where the light sources are arranged in at least one inner and at least one outer group (such as those illustrated in FIGS. 4*a*, 4*b* and 4*c*) the filtering effect can be applied to the outer group.

It is noticed that the projecting light fixture 301 also can be integrated as the head of a moving head light fixture comprising a head rotatable connected to a yoke, where the yoke is rotatable connected to a base. The moving head light fixture comprises pan rotating components for rotating the yoke in relation to the base and tilt rotating components for rotating the head in relation to the yoke. The skilled person will realize that the pan and tilt rotation means can be constructed in many different ways using mechanical components such as motors, shafts, gears, cables, chains, transmission systems, bearings etc. In moving head light fixtures, it is possible to arrange the controller 317 and/or the internal power supply 353 in the yoke or in the base.

Figure 5:
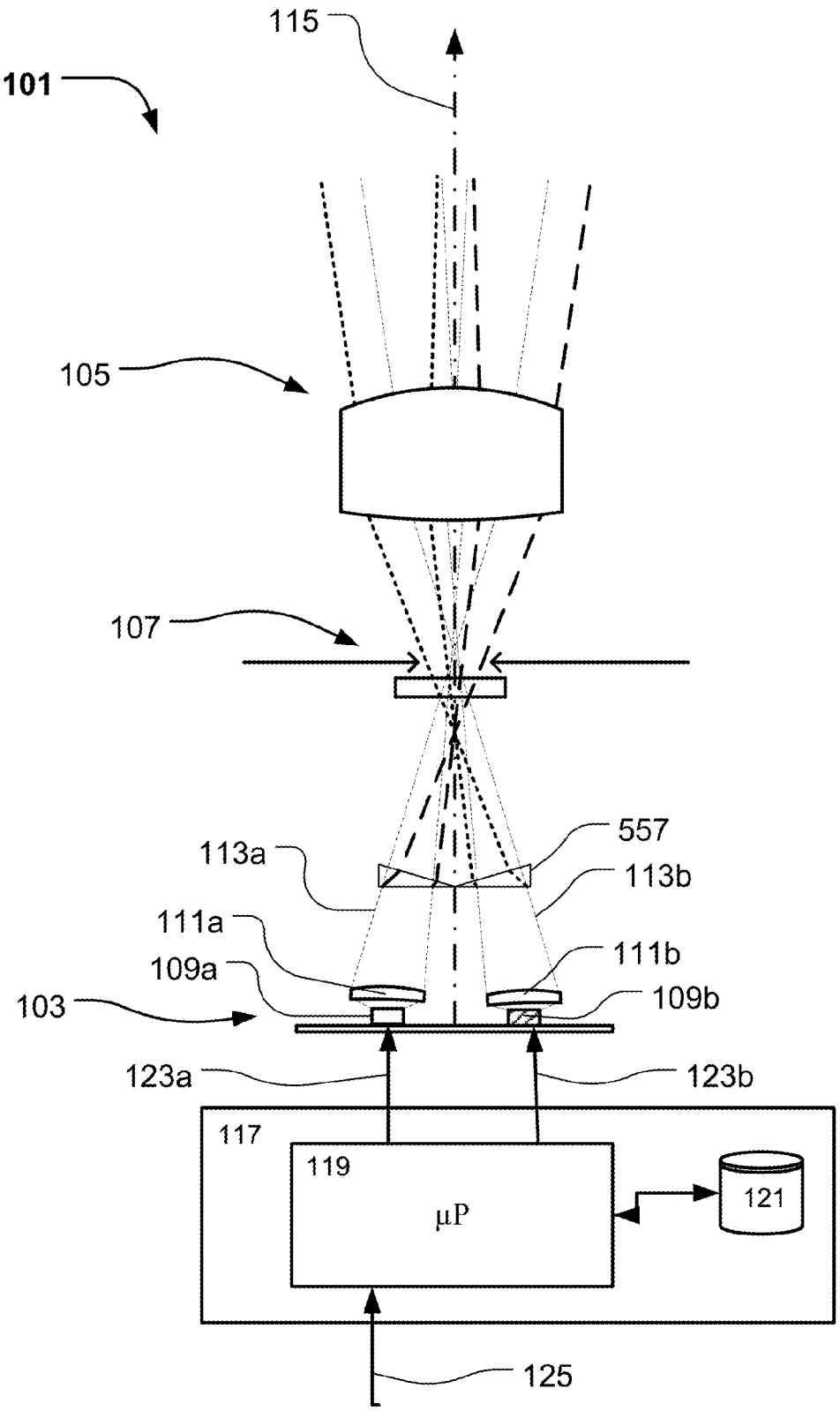
FIG. 5 illustrates a structural diagram of another embodiment of a projecting light fixture according to the present invention.

FIG. 5 illustrates a structural diagram of a projecting light fixture 501 according to the present invention. The projecting light fixture 501 is similar to the projecting light fixture 101 illustrated in FIG. 1 and similar features are labeled with the same reference numbers and will not be described in further details. In this embodiment, the projecting light fixture comprises at least one enhancing optical component 557 which is movable between a non-enhancing position and an enhancing position where the enhancing optical component in the enhancing position is configured to enhance the difference between the first illumination provided by the first group and the second illumination provided by the second group. The enhancing optical component can be configured to increase the difference between the first illumination and the second illumination by increasing the angle difference between the first source light beams and the second source light beams, by directing the first source light beams and second light beam towards different areas (e.g. by decreasing the overlap in illuminated areas) of the beam shaping object and/or by increasing the difference in light distribution of the first source light beams and the second light beams at the beam shaping object. As a consequence, the enhancing optical component makes it possible to increase the differences between the different light patterns created by the different groups of light sources resulting in the fact that more different light effects and patterns can be provided.

The enhancing optical component can be any optical component which can be inserted into the source light beams and which can change the illumination of the light from the first group and/or the second group at the optical gate. For instance, the enhancing optics may be embodied as lenses or a plurality of lenses configured to change the convergence or the beam width of the source light beams; prisms configured to refract the source light beam in desired directions; engineered diffusers configured to changes the light distribution the source light beams; etc. In the illustrated embodiment, the enhancing optical component 557 is embodied as a pair of prisms which refracts the first and second source light beams into a first refracted source light beam 559*a* (illustrated in thick dashed line) and into a second refracted source light beam 559*b* (illustrated in thick dotted line). The refraction of the first and second source beams results in the fact that the overlapping area at the optical gate between the first and second source light beams are decreased and the differences between the first and second illumination of the beam shaping object is thus increased. As a result, the differences between the projected light patterns are increased. The original source light beams 113*a* and 113*b* are illustrated, respectively, by thin dashed lines and thin dotted lines. In the illustrated embodiment, the enhancing optical component is inserted into the light source beams in order to enhance the differences between the first illumination and the second illumination of the beam shaping object and where the difference between the first illumination and the second illumination is reduced when the enhancing optical component is removed from the source light beams. The movement of the enhancing optical component can be provided by any mechanical components and actuators as known in the art.

In an embodiment, the light projecting light fixture can comprise a minimizing optical component configured to minimize the differences between the first illumination and the second illumination, for instance, by decreasing the angle difference between the first source light beams and the second source light beams, by directing the first source light beams and second light beam towards the same areas (e.g., by increasing the overlap in illuminated areas) of the beam shaping object and/or by providing similar light distribution of the first source light beams and the second source light beams at the beam shaping object. As a consequence, the minimizing optical component makes it possible to minimize the differences between the different light patterns created by the different groups of light sources resulting in the fact the when the light pattern created by the different groups of light sources and light collectors are very similar which improves the imaging quality of the projecting system when the groups of light sources are used as one common light source in order to increase the overall light intensity. The minimizing optical component is inserted into the light source beams in order to minimize the differences between the first illumination and the second illumination when the minimizing optical component is inserted into the source light beams. The minimizing optical component can thus be moved between a minimizing position inside the source light beams and a non-minimizing position outside the source light beams.

FIGS. 6*a*-6*d* illustrate a structural diagram of different embodiments of a light projecting fixture 601*a*-601*d* according to the present invention. The projecting light fixtures 601*a*-601*d* respectively illustrated in FIGS. 6*a*-6*d* are similar to the projecting light fixtures illustrated in FIG. 1 and FIG. 2*a* and similar features are labeled with the same reference numbers and will not be described in further detail. FIGS. 6*a*-6*d* illustrate different embodiments of the light source module 603*a*-603*d* of the projecting light fixtures. Projecting light fixtures 601*a*-601*d* comprise a light source module 603*a*-603*d*, a projecting system 105 and an optical gate 107 arranged between the light source module 603*a*-603*d* and the projecting system 105. At least one beam shaping object 106 such as gobos, animation wheels, frost filters, framing blades, an iris, color filters, prisms, textured gobos etc., is arranged near the optical gate. The beam shaping objects is configured to modify the light passing through the optical gate. The controller is not illustrated in FIGS. 6*a*-6*d*, however it is to be understood that a controller similar to the controller previously described is configured to control the different components of the illumination device 601*a*-601*d* and that the controller is configured to control at least two groups of light sources individually and the at least two groups are configured to illuminate the beam shaping device differently.

Figure 6A:
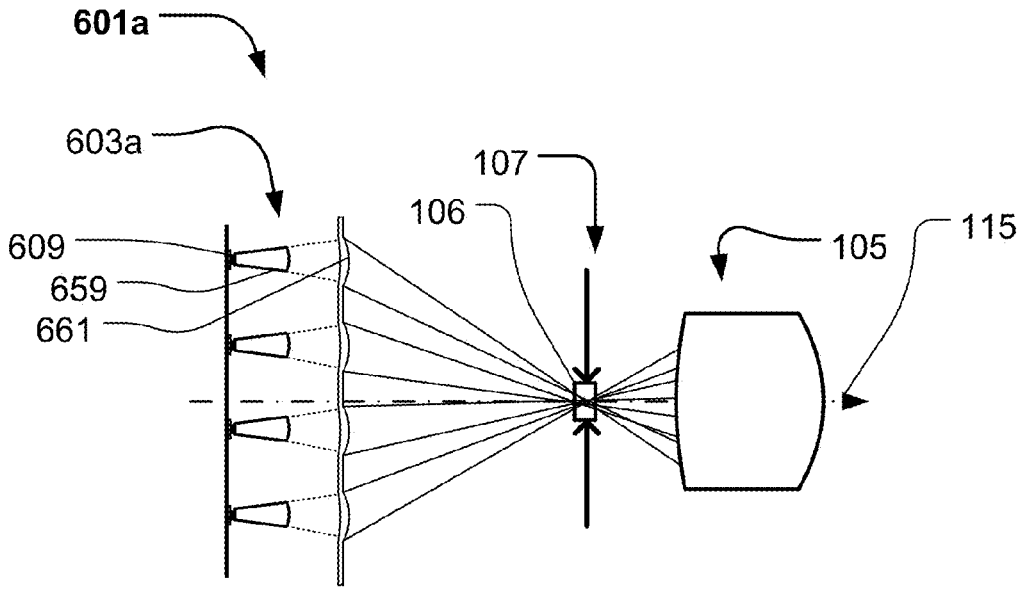
FIGS. 6*a*-6*d* illustrate different embodiments of a light source module of the illumination device according to the present invention.

FIG. 6*a* illustrates an embodiment where the light collectors have been embodied as a plurality of light mixing rods 659, where light from the light sources 609 enters the light mixing rod in one end and is transmitted to the other end where the light exits the light mixing rod. A lens 661 is configured to collect the light from the light mixing rod and direct the collected light towards the optical gate 107 and beam shaping object 106. In an embodiment where the light sources have been embodied as multiple die LEDs (e.g., RBG, RGBW etc.), the light mixing rod serves to mix the light from the different dies of the LEDs and the outgoing light is thus mixed into a uniform light beam as known in the art of light mixing rods. In the illustrated embodiment, there is one lens pr. light mixing rod, however it is to be understood that a lens in some embodiments can receive light from a plurality of light mixing rods.

Figure 6B:
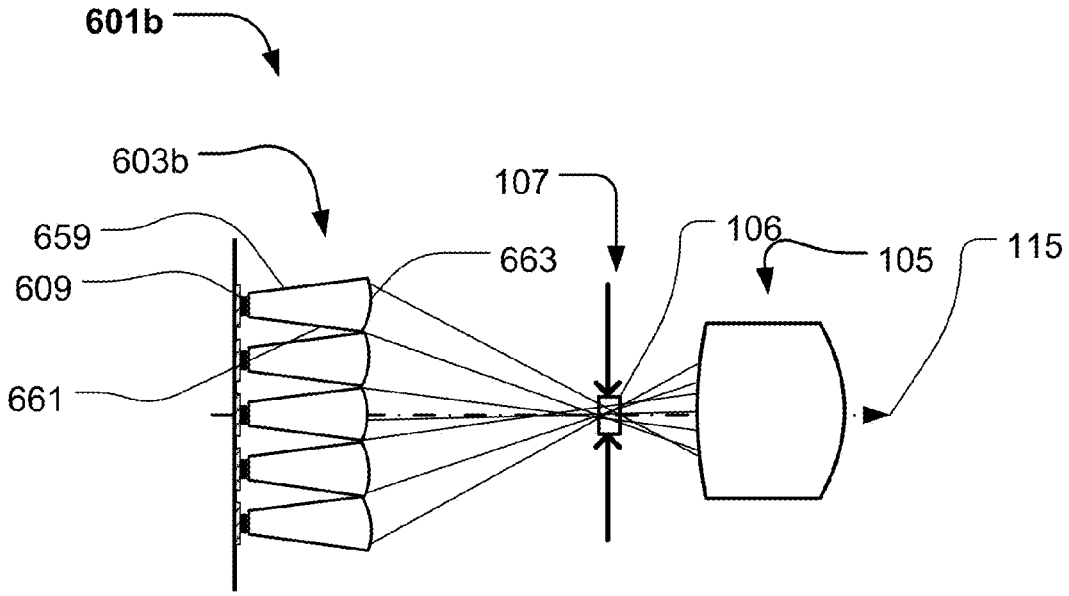

FIG. 6*b* illustrates an embodiment where light collectors have been embodied as a plurality of light mixing rods 659, where light from the light sources 609 enters the light mixing rod in one end and is transmitted to the other end where the light exits the light mixing rod. In this embodiment, the exit surface 663 of the light mixing rod is configured to direct the exiting light towards the optical gate and beam shaping object 106, for instance by configuring the refractive properties of the exit surface.

Figure 6C:
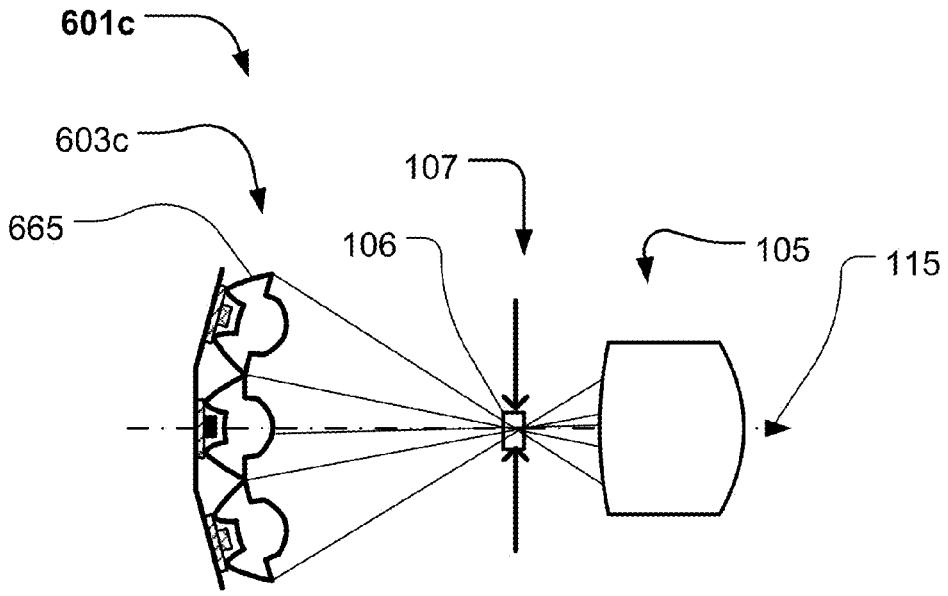

FIG. 6*c* illustrates an embodiment where the light collectors have been embodied as TIR lenses 665. The TIR lenses are configured to collect light from the light sources 609 and direct the collected light towards the optical gate 107 and the beam shaping object 107. The TIR lenses comprise a peripheral part collecting a peripheral part of the light generated by the light sources and direct the peripheral part of the light toward the optical gate. In the peripheral part, the collected light is reflected forwardly using total internal reflection at the outer wall of the peripheral part. The TIR lens comprises a central part configured to collect a central part of the light generated by the light source and to direct the central part of the light towards the optical gate and beam shaping object. In the illustrated embodiment, the light sources and TIR lenses have been angled in relation to each other in order to focus the source light beams at the optical gate where the beam shaping object is arranged. However, it is to be understood that the light sources and TIR lenses do not need to be tilted in relation to each other as the exit surface for the peripheral part and the central part can be configured to deflect and focus the source light beams at the optical gate, also a lens as shown in FIG. 6*a* can be used to direct the light towards the optical gate.

Figure 6D:
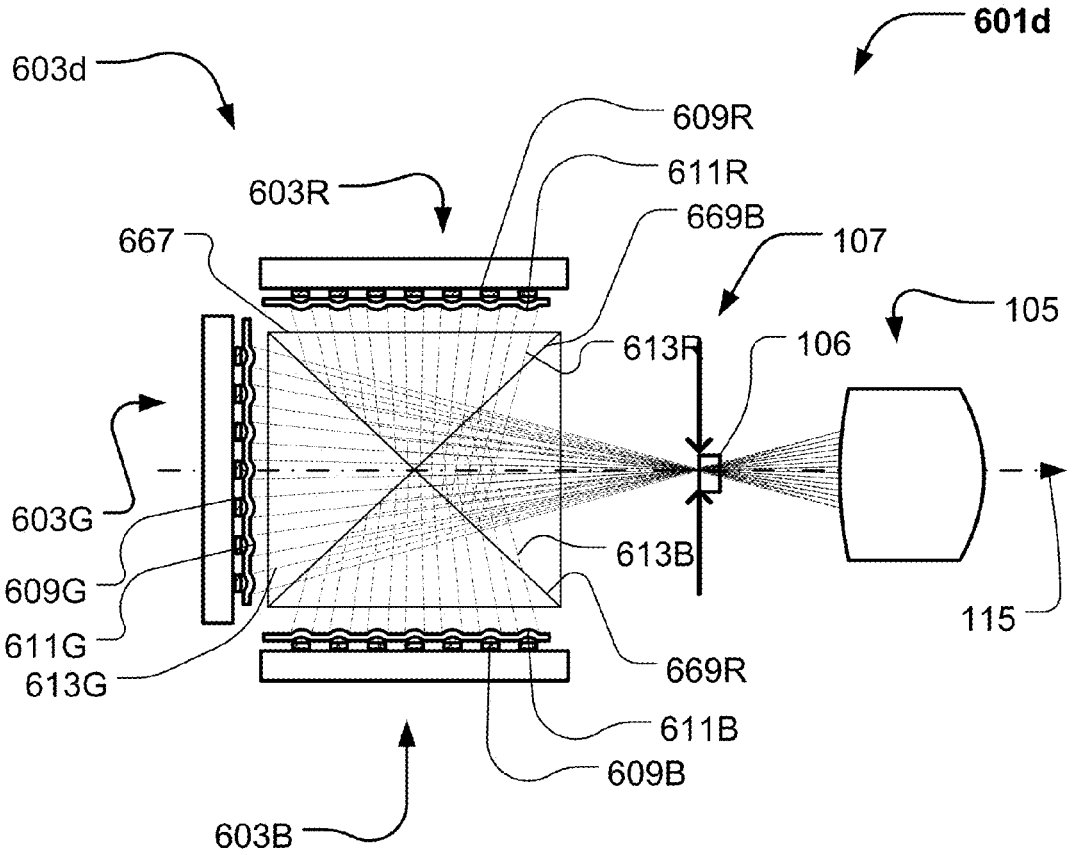

FIG. 6*d* illustrates an embodiment where the light source module 603*d* comprises a red light source module 603R, a green light source module 603G, a blue light source module 603B and a color cube 667. The red light source module comprises a plurality of red light sources 609R, the green light source module 603G comprises a plurality of green light sources 609G and the blue light source module 603B comprises a plurality of blue light sources 609B. The light from the red, green and blue light sources are combined into a common light beam using dichroic filters of the color cube. The color cube 667 comprises a "red" dichroic filter 669R adapted to reflect red light and transmit other colors and a "blue" dichroic reflector 669B adapted to reflect blue light and transmit other colors. The red and blue light will thus be reflected by the red dichroic filter 669R and the blue dichroic filter 669B respectively whereas the green light will pass directly through the color cube. The consequence is an output light beam which appears white in accordance with the rules of additive color mixing.

The red light source module comprises a plurality of red light collectors 611R configured to collect light from the red light sources 609R and to convert the collected light into red source light beams 613R (illustrated as dashed lines). The plurality of red light sources and the plurality of red light collectors are arranged in a plurality of groups, where each group comprises at least one red light source and at least one red light collector and provide a red illumination of the beam shaping device near the optical gate and where the plurality of red illuminations of the beam shaping object are different. A controller is configured to control the plurality of red groups individually as described previously. It is noted that the red light sources and red light collectors can be grouped, controlled and provided as any of the embodiments described above.

The green light source module comprises a plurality of green light collectors 611G configured to collect light from the green light sources 609G and to convert the collected light into green source light beams 613G (illustrated as dotted lines). The plurality of green light sources and the plurality of green light collectors are arranged in a plurality of groups, where each group comprises at least one green light source and at least one green light collector and provides a green illumination of the beam shaping object near the optical gate and where the plurality of green illuminations of the optical gate are different. A controller is configured to control the plurality of green groups individually as described previously. It is noted that the green light sources and the green light collectors can be grouped, controlled and or provided as any of the embodiments described above.

The blue light source module comprises a plurality of blue light collectors 611B configured to collect light from the blue light sources 609B and to convert the collected light into blue source light beams 613B (illustrated as dash-dotted lines). The plurality of blue light sources and the plurality of blue light collectors are arranged in a plurality of groups, where each group comprises at least one blue light source and at least one blue light collector and provides a blue illumination of the beam shaping object near the optical gate and where the plurality of blue illuminations of the bean shaping device are different. A controller is configured to control the plurality of blue groups individually as described previously. It is noted that the blue light sources and the blue light collectors can be grouped, controlled and or provided as any of the embodiments described above.

This embodiment makes it possible to provide similar light effects as described previously, with the addition that the light effects can be provided using each of the three primary colors in a color cube system and the intensity of each of the primary colors are high.

Figure 7A:
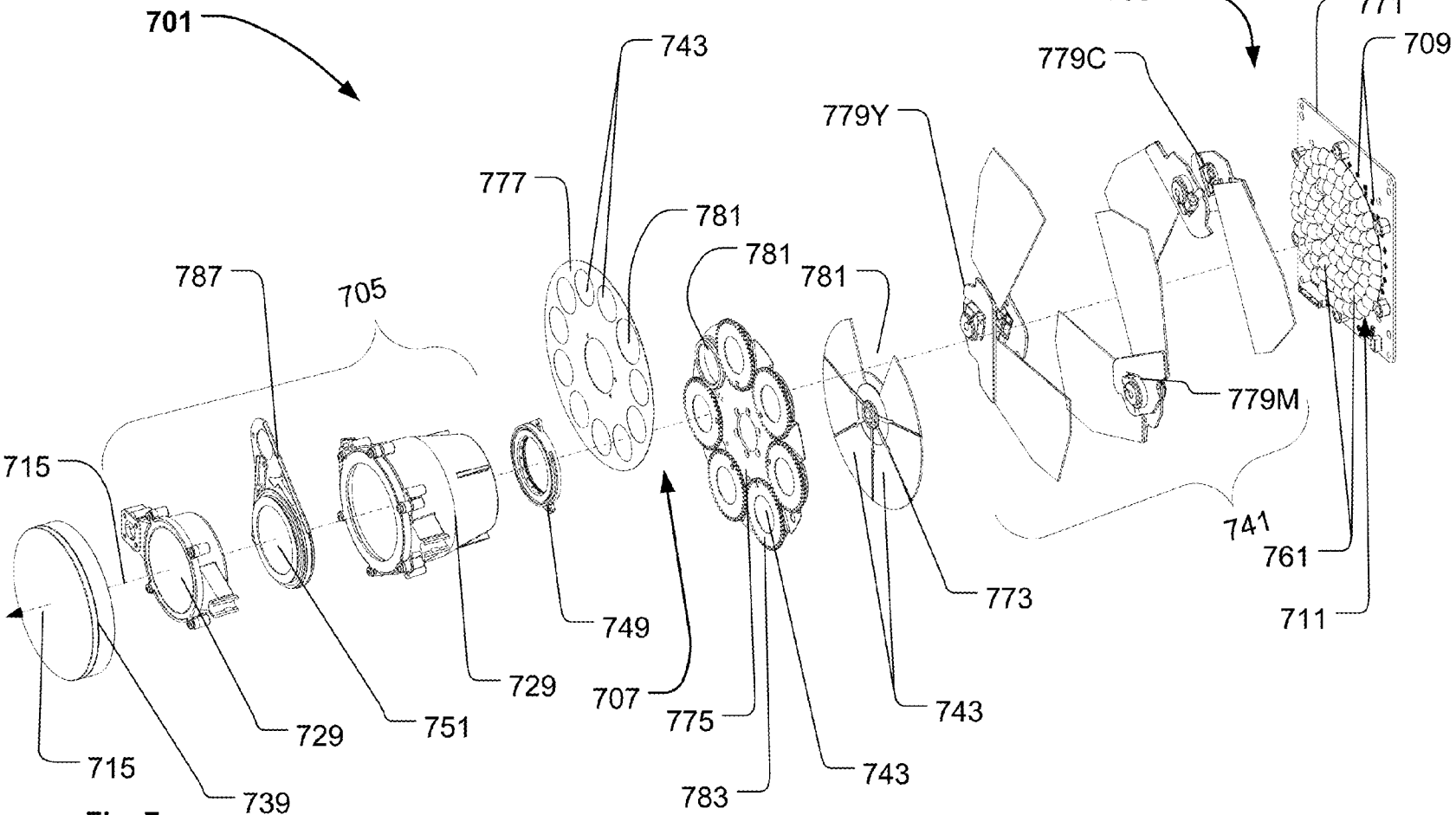
FIGS. 7*a*-7*c* illustrate another embodiment of the projecting light fixture according to the present invention.
Figure 7B:
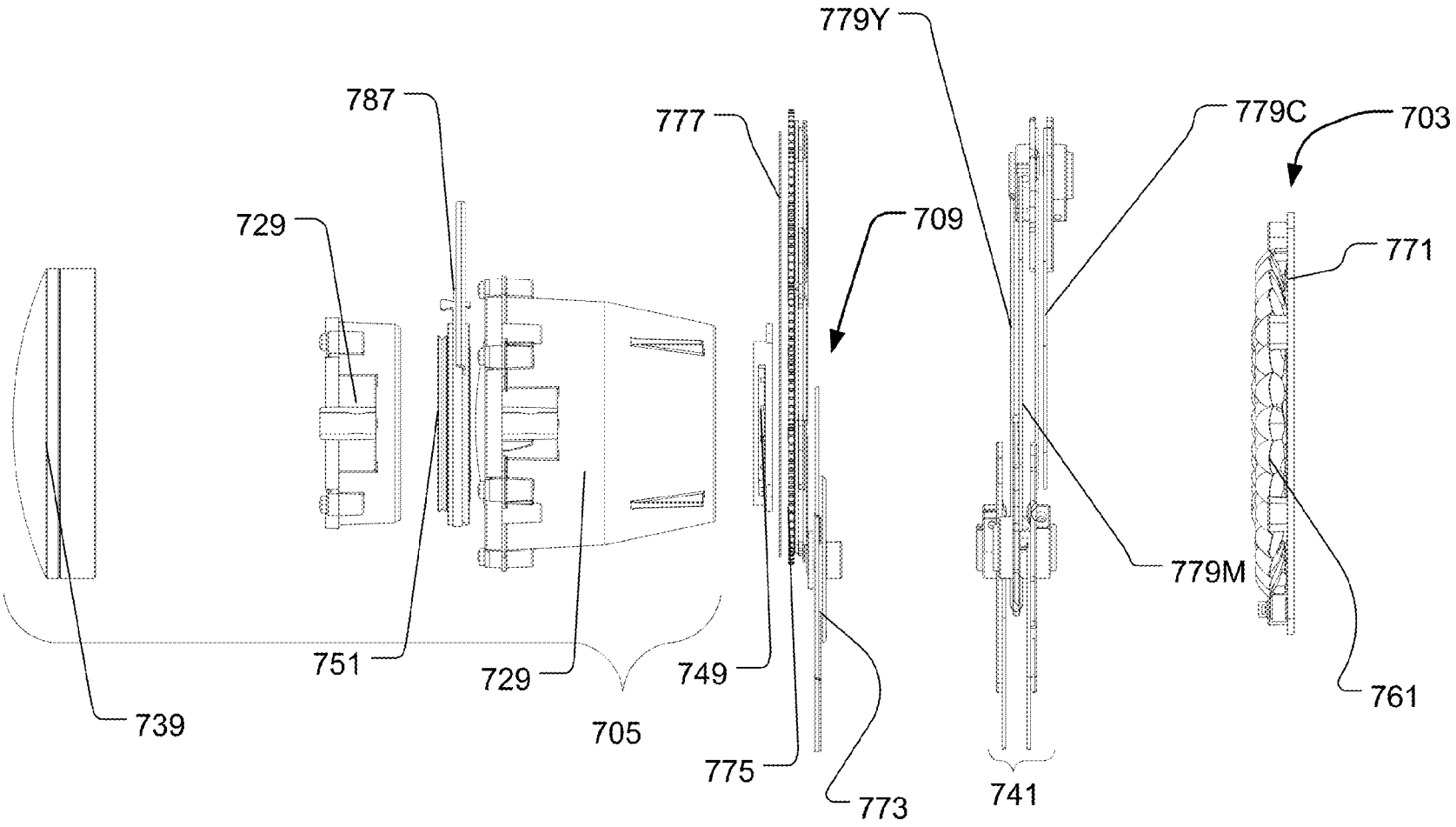
Figure 7C:
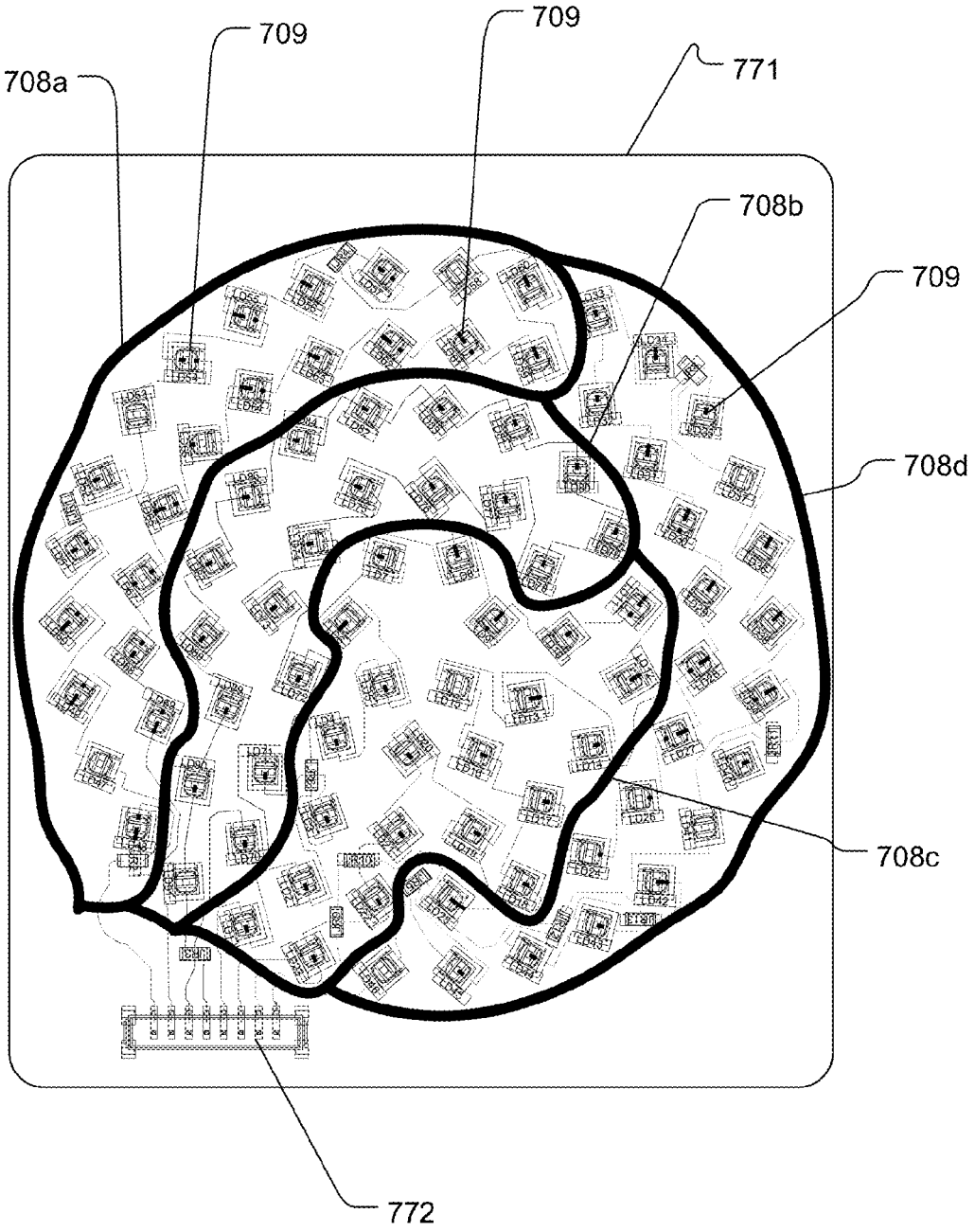

FIGS. 7*a*-7*c* illustrate and embodiment of a projecting light fixture 701 according to the present invention, where FIG. 7*a* illustrates an exploded view, FIG. 7*b* illustrates a top view and FIG. 7*c* illustrates a front view of the light source module 703 with the light collector removed. FIGS. 7*a*-7*c* only illustrates the main components of the projecting light fixture and several components have been omitted for the sake of simplicity. For instance, structural components such as carrying plates, electrical components and actuators have been omitted.

The projecting light fixture comprises the same basic components as the projecting light fixtures illustrated in FIGS. 1, 2, 3 and similar elements providing similar effects have in FIGS. 7*a*-7*c* been given the same last two digits as in FIGS. 1, 2 and 3 and the components are arranged in a housing (not shown)

The projecting light fixture comprises a light source module 703 comprising a plurality of LEDs 709 arranged on a LED PCB 771 and a light collector comprising a plurality of lenslets 761. Each of the lensets 761 is configured to collect light from a corresponding LED 709 and convert the collected light into a corresponding source light beam propagating along the primary optical axis 715. A projecting system 705 is configured to collect at least a part of the light beams and to project the collected light along the primary optical axis 715. The LEDs 709 and lenslets are arranged in a plurality of groups as described previously and can thus create a plurality of different illuminations of the optical gate.

FIG. 7*c* illustrates a front view of the LED PCB 771. The LED PCB comprises 90 LEDs arranged in a circular pattern. The LEDs are arranged in four groups and the LEDs of each group are connected serially in a string. The lead wires of each string are illustrated in different types of lines. Each of the strings is connected to a power supply/driver (not shown) through a connector 772. The power supplies/driver is configured to deliver electrical power to the LEDs whereby there intensity can be controlled by controlling the power supplied to the LEDs. A controller can for instance be configure to instruct the power supply/driver to control the light intensity of the LEDs of each of the LED strings by using a PWM signal or a DC signal. The extend of the first 708*a*, the second 708*b*, the third 708*c* and the fourth 708*d* groups of LED have been illustrated in thick lines. However it is to be understood that many groupings can be provided.

In the illustrated embodiment the light is directed along the optical axis 715 by the light collector 711 and passes through a number of light effect components before exiting the light fixture through a front lens 739. In this embodiment the projecting light fixture 701 comprises a CMY color mixing system 741, a color wheel 773, a rotating gobo wheel 775, a fixed gobo wheel 777, an iris diaphragm 749, an optical focus group 729, a prism 751 and an optical zoom group 727.

The CMY color mixing system 741 comprises a pair of cyan flags 779C, a pair of magenta flags 779M, and a pair of yellow flags 779Y, which can be inserted into the source light beams by actuators (not shown) and provide a color filtering effect. The color of the source light beam can thus be controlled using subtractive color mixing. The CMY flags can be inserted partially into the source light beams and can thus be arranged in light originating from one of the groups while light from another group does not hit the CMY flags. Color light effects where the color of light originating from one group of light sources are different from the color of light originating from another group of light sources can hereby be provided. For instance, in this embodiment, the CMY flags can be arranged partially in the light source beams such that light originating from the first group 708*a* and fourth group 708*d* hits the CMY flags while light from the second and third group do not hit the CMY flags. It is noticed that the CMY flags and the mechanics moving the CMY flags can be embodied in many ways as known in the art of entertainment light fixtures.

The color wheel 773 comprises a plurality of color filters 743 of different colors the color wheel can be rotated around a center axis by an actuator (not shown) and the color filters can hereby be inserted into the source light beams. The color wheel comprises also an open section 781 which can be inserted into the source light beams and whereby no color effect is applied to the source light beams by the color wheel. The color wheel and color filters can be embodied in any way as known in the art of entertainment lighting.

The rotating gobo wheel 775 comprises a plurality of gobos 743, where each of the gobos are arrange in a gobo holder 783 enabling rotation of the gobo around it's center axis. Each of the gobos are arranged in a bearing comprising a toothed wheel which engages a center toothed wheel (not shown) and rotation of the center toothed wheel results in rotation of the rotating gobo holders. The gobo wheel can also be rotated in order to arrange different gobos in the source light beams and comprises also an open section 781 with no gobo. In this embodiment, the optical gate is defined by the gobos and the open section of the rotating gobo wheel. The rotating gobo wheel, gobo holders and gobos filters can be embodied in any way as known in the art of entertainment lighting.

The projecting light fixture comprises also a fixed gobo wheel 777, which comprises a plurality of fixed gobos 743 and an open section 781. The fixed gobo wheel can be rotated in order to arrange the gobos in the source light beams. The fixed gobo wheel can be embodied in any way as known in the art of entertainment lighting.

An iris diaphragm 749 has been arranged after the fixed gobo wheel and can be used to delimit the source light beams. The iris diaphragm can be embodied in any way as known in the art of entertainment lighting.

The optical focus group 729 can be moved along the primary optical axis by an actuator (not shown) and optical focus group can thus be used to provide a sharp image of the gobos at a target surface along the primary optical axis. However it is also possible to arrange the optical focus group in non-focusing positions if desired. The optical zoom group 727 can be moved along the primary optical axis in order to change the size and/or divergence of the light beams. A faceted prism is arranged on a prism arm 787, which can move the prism in and our out of the source light beams. Additionally, the prism arm comprises a mechanism which can rotate the prism around its own central axis when arranged in the source light beams. The facets of the prism deflects the source light beam and creates a number of "copies" of the source light beams as known in the art of entertainment lighting. The number of facets determines the number of copies. For example, a 3-faceted prism will create three copies of the source light beams and in an image projecting system three identical images will be created offset each other. The optical focus group, the optical zoom group the prism can be provided in any way as known in the art of entertainment lighting. The controller can be configured to coordinate the rotation of the prism in relation the variations of the different illuminations of the beam shaping object. This makes it possible to rotate the "copies" of the light patterns in relation to the primary optical axis and at the same time change the light patterns using by varying the intensity of the different illuminations.

Figure 8:
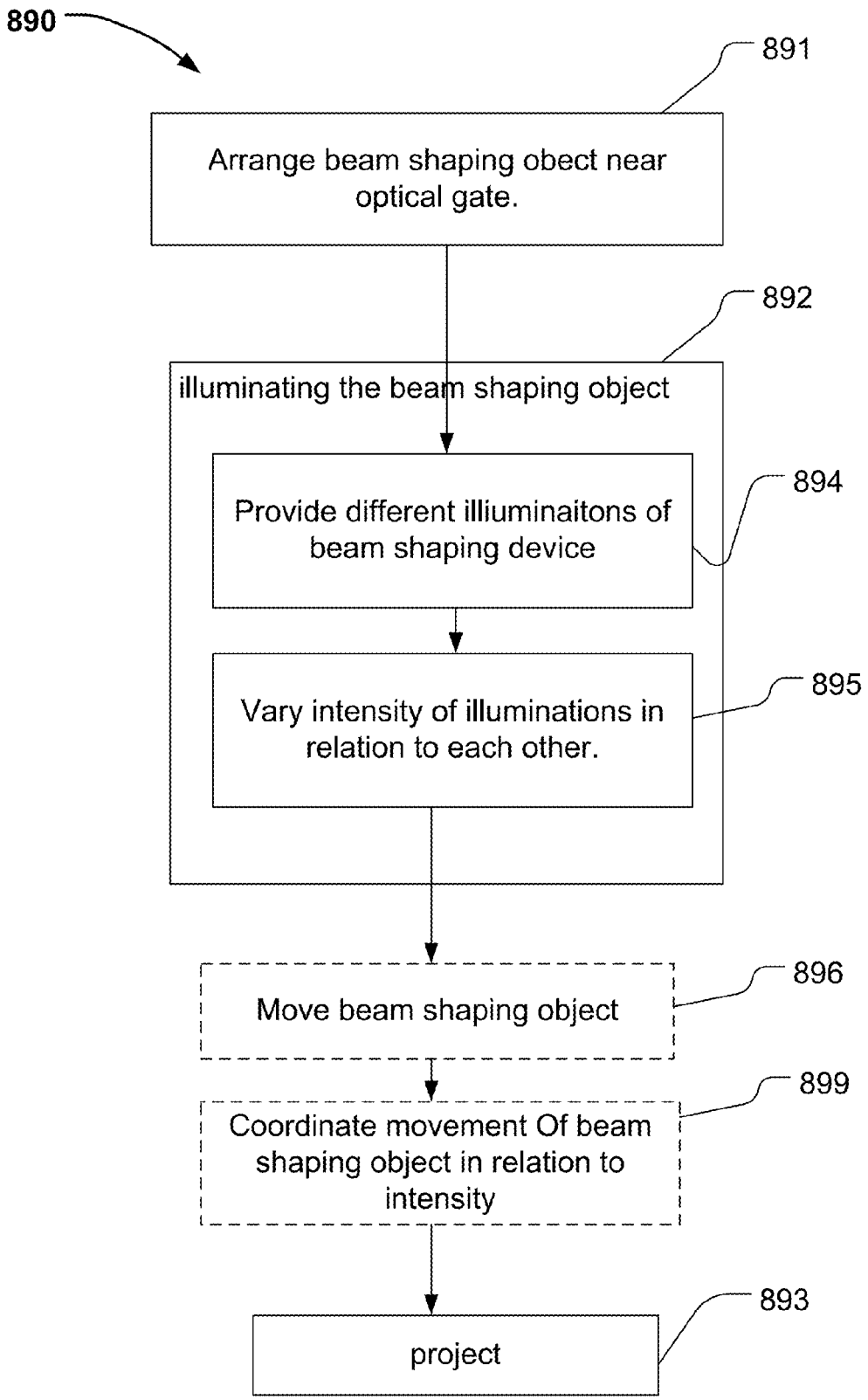
FIG. 8 illustrates a method of creating a light effect according to the present invention.

FIG. 8 illustrates a simplified flow diagram of a method 890 of crating light effects according to the present invention. The method comprises step 891 of arranging a beam shaping object near an optical gate of a projecting light fixture, step 892 of illuminating the beam shaping object with light and step 893 of projecting light 893 passing through the beam shaping object along a primary optical axis.

The step 891 of arranging the beam shaping object near an optical gate can be performed by arranging any of the beam shaping objects 106 of the projecting light fixtures shown in FIGS. 1, 2, 5 and 6*a*-6*d* near the optical gate defined by the source light beams created by the light source module 103, 603*a*-*d*. This step can also be performed by arranging the gobos 345, animation effects 347 and/or the iris diaphragm 349 of the projecting light fixture 301 in FIG. 3 in the source light beams. Similar, the step can also be performed by arranging one of the gobos of the rotating gobo wheel 775, one of the fixed gobos of fixed gobo wheel 777 and/or the iris diaphragm 749 in the source light beams of the projecting light fixture illustrated in FIGS. 7*a*-7*b*.

The step 892 of illuminating the beam shaping object with light can be performed by using a plurality of light sources and a plurality of light collectors, where the light collectors collect light from at least one of the light sources and convert the collected light into a source light beam, The source light beam propagates at least partially along a primary optical axis. This can be done by using any of the light source modules of the projecting light fixtures illustrated in FIGS. 1, 2, 3, 5, 6*a*-6*d*, 7*a*-7*c*.

The step of projecting 893 the light passing through beam shaping object along a primary optical axis can be performed by using a projecting system, where the projecting system is configured to collect a part of the light generated by the light sources and which pass through the beam shaping object. The projecting system can be any optical projecting system such that any of the optical systems described previously in connection with the projecting light fixtures of FIGS. 1, 2, 3, 5, 6*a*-6*d*, 7*a*-7*c*.

Additionally, the step 892 of illuminating the beam shaping object comprises step 894 of providing a plurality of different illuminations at the beam shaping object and the step of varying 895 the intensity of the plurality of different illuminations in relation to each other.

The method of creating light effects 890 according to the present invention makes it possible to provide a large number of new light effects. By illuminating the beam shaping object with a plurality of different illuminations and controlling the intensity of the different illuminations in relation to each other, this condition makes it possible to create a large number of light effects as each different illumination creates its own light effects and by varying the intensity of the different illuminations makes it possible to create a very large number of new light effects. The intensity of the different illuminations can be varied dynamically in relation to each other whereby animated light effects can be created. In fact, it is possible to provide animated light effects without moving the beam shaping object in relation to the source light beams, as is common practice in the prior art. However, it is also possible to combine the variation of intensity of the different illuminations with movements of the beam shaping object, which results in even more new light effects. The method can thus optionally also comprise step 896 of moving the beam shaping object in relation to the source light beams and step of 899 coordinating movement of the beam shaping object in relation the step of varying the intensity of the different illuminations in relation to each other.

Figure 9:
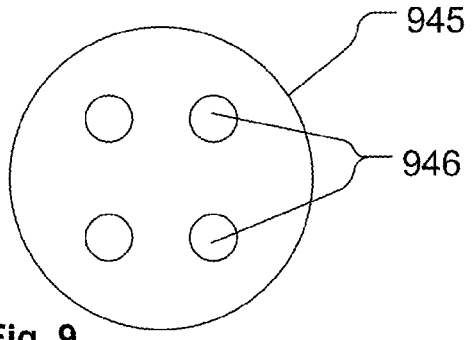
FIG. 9 illustrates an exemplary gobo used as beam shaping object in a projecting light fixture according to the present invention.

FIG. 9 illustrates an example of a beam shaping object used in a projecting light fixture according to the present invention. The beam shaping object is embodied as a gobo 945 comprising four circular openings 946 where through light can pass. The gobo can is embodied as a metal plate where the openings are provided as cut-outs as a glass plate with a shielding coating around the openings.

Figure 10A:
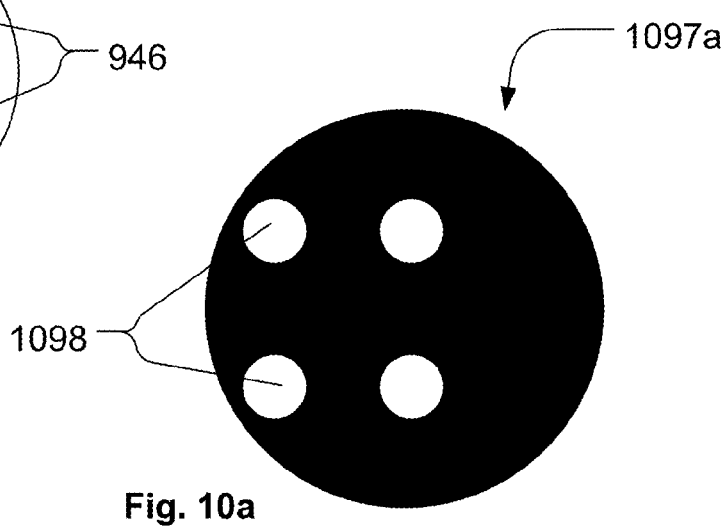
FIGS. 10*a*-10*c* illustrate illuminations created by a projecting light fixture according to the present invention and using the gobo in FIG. 9 as beam shaping object.
Figure 10B:
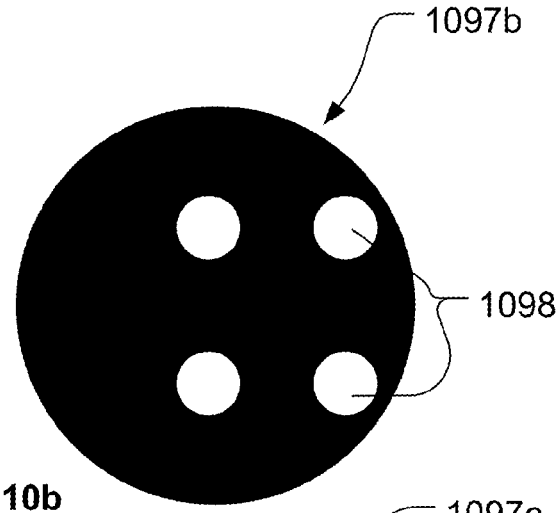
Figure 10C:
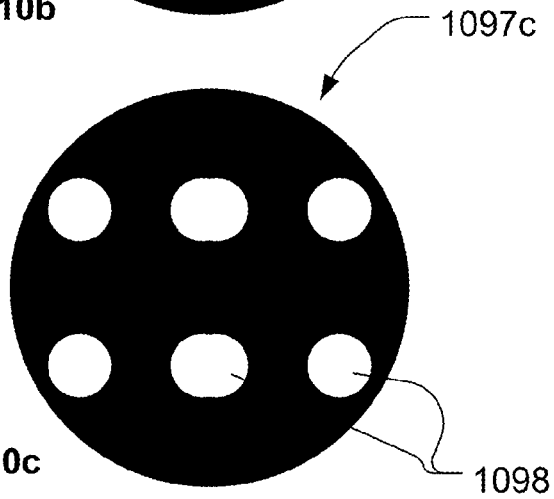

FIGS. 10*a*-10*c* illustrate different illuminations 1097*a*-1097*c* which can be created by a projecting light fixture according to the present invention using the gobo illustrated in FIG. 9 as beam shaping object. The illuminations in FIGS. 10*a*-10*c* are created by a projecting light fixture with a light source module that can create two different illuminations of the gobo 945. The light source module comprises thus two groups of light sources and light collectors and can for instance be grouped as shown in FIGS. 1 and 5.

FIG. 10*a* illustrates the illumination 1097*a* with the first group of light sources driven at full intensity and the second group turned off. FIG. 10*b* illustrates the illumination 1097*b* with the first group turned off and the second group driven at full intensity. It can be seen that the images of the openings 1098 are displaced in relation to each other depending on which of the groups of light sources are turned on; which is due to the fact that the two groups creates different illuminations of the gobo. FIG. 10*c* illustrates the situation where both groups at the same time are driven at full intensity and it can be seen that the two illuminations 1097*a* and 1097*b* are superposed.

Figure 11A:
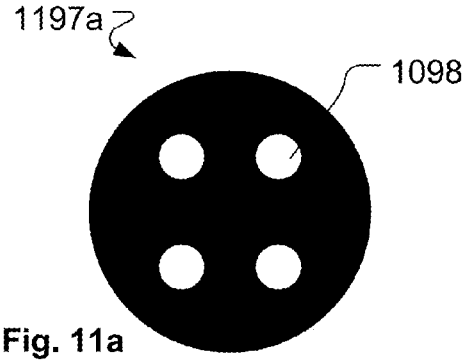
FIGS. 11*a*-11*h* illustrate illuminations created by a projecting light fixture according to the present invention and using the gobo in FIG. 9 as beam shaping object.
Figure 11B:
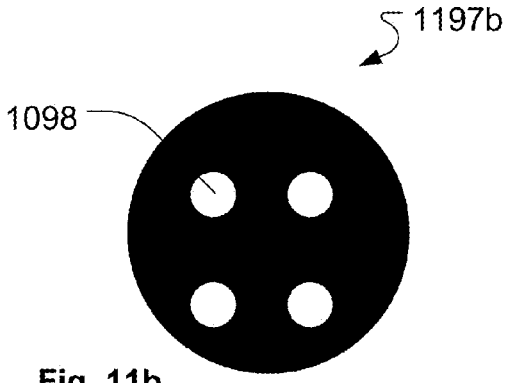
Figure 11C:
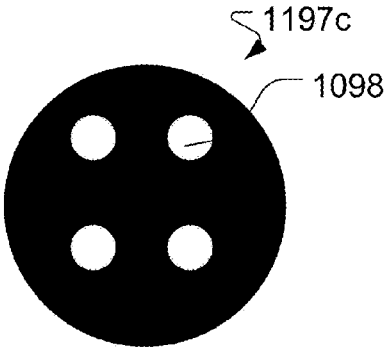
Figure 11D:
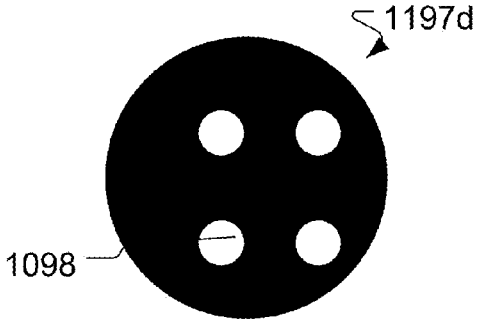
Figure 11E:
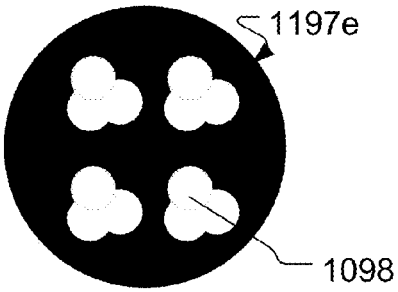
Figure 11F:
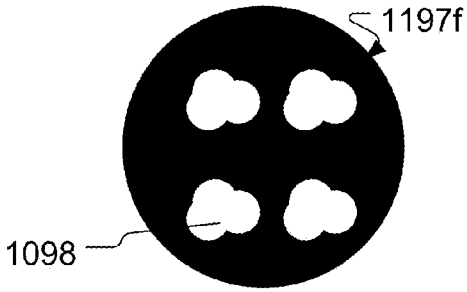
Figure 11G:
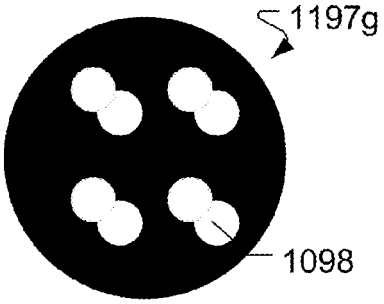
Figure 11H:
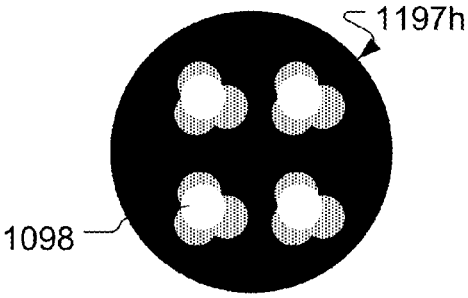

FIGS. 11*a*-11*h* illustrate different illuminations 1197*a*-*h* which can be created by a projecting light fixture according to the present invention using the gobo illustrated in FIG. 9. The illuminations 1197*a*-1197*h* are created by a projecting light fixture with a light source module which can create four different illuminations of the gobo 945. The light source module comprises thus four groups of light sources and light collectors and the groups are arranged as shown in FIG. 4*b*. FIGS. 11*a*-11*d* illustrate the illuminations 1197*a*-1197*d* where respectively the first group 408*a*, the second group 408*b*, the third group 408*c*, and the fourth group 408*d* of light sources are driven at full intensity while the other groups are turned off. FIG. 11*e* illustrates an illumination 1197*e* where all groups of light sources are driven at full intensity. FIG. 11*f* illustrates an illumination 1197*f* where the first 408*a*, the second 408*b* and fourth 408*d* group of light sources are driven at full intensity while the third group 408*c* is turned off. FIG. 11*g* illustrates an illumination 1197*g* where the third group 408*c* and fourth group 408*d* of light sources are driven at full intensity while the first 408*a* group and the second group 408*b* are turned off. FIG. 11*h* illustrates an embodiment where the first group 408*a* is driven at full intensity, while the second 408*b*, third 408*c* and fourth 408*d* groups are driven at 50% intensity. As a consequence, the center circle of illumination is brighter than the surrounding parts, as the surrounding parts do not have an overlapping part with the other illuminations. This has been illustrated by the fact that the circles provided by the second, third and fourth groups have been shaded. It is to be understood that only 8 combinations of illuminations have been illustrated and that many other illuminations can be created by varying the intensity of the four groups in relation to each other.

Figure 12A:
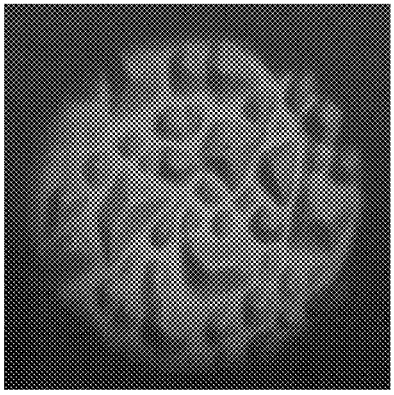
FIGS. 12*a*-12*g* illustrate illuminations created by a projecting light fixture according to the present invention and using a textured glass gobo as beam shaping object.
Figure 12B:
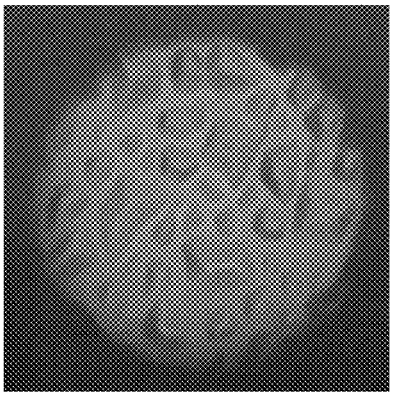
Figure 12C:
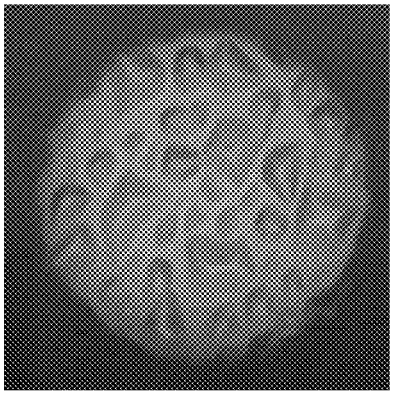
Figure 12D:
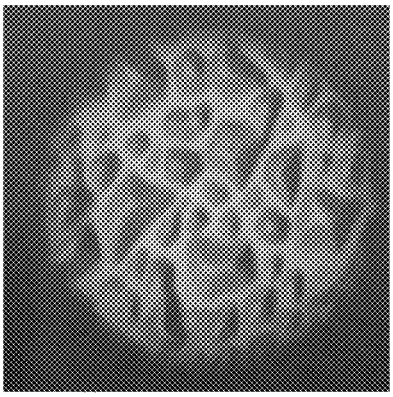
Figure 12E:
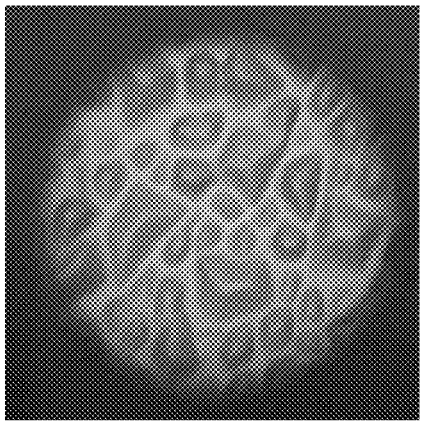
Figure 12F:
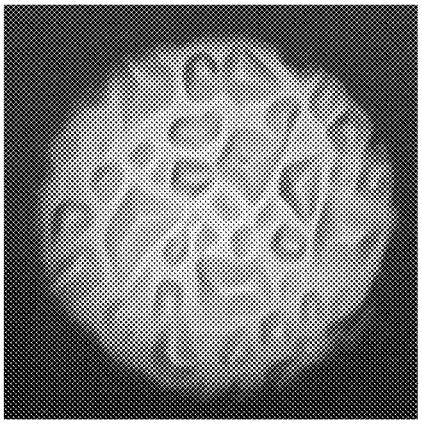
Figure 12G:
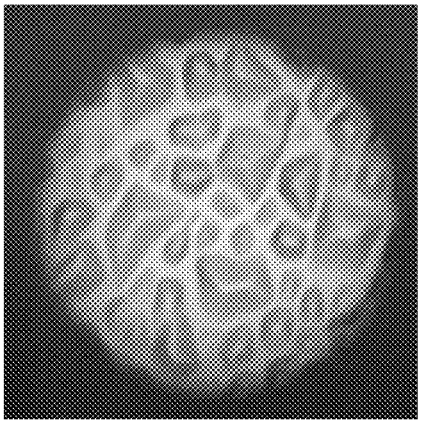

FIGS. 12*a*-12*g* illustrates different illuminations created by using a textured glass gobo in the illumination device shown in FIGS. 7*a*-*c*, where the projecting system has focused the surface of the textured gobo at a target surface. The textured gobo comprises a plurality of refractive elements. The illuminations have been recorded by photographing the illumination of the target surface using the same aperture and shutter settings of a camera and then de-saturating the photos to black and white. The different illuminations are provided by driving the four groups 708*a*-708*d* differently in relation to each other. FIGS. 12*a*-12*d* illustrate the illumination where respectively the first, second, third, and fourth group have been driven at full intensity while the other groups have been turned off. FIG. 12*e* illustrates an illumination where the first and fourth groups are driven at full intensity while the second and third groups are turned off. FIG. 12*f* illustrates the opposite situation where the second and third groups are driven at full intensity while the first and fourth groups are turned off. Finally, FIG. 12*g* illustrates the illumination where all four groups have been driven at full intensity.

Throughout FIGS. 12*a*-12*g*, it can be seen that by controlling the intensity of the different groups of light sources that the illumination at the target surface can be changed. As a consequence, it is possible to create many light patterns simply be varying the intensity of the light sources in relation to each other. It is noticed that the difference in illuminations in this embodiment primarily can be seen as changes in the shadows at the textured glass pattern. Additionally, since the human eye is very sensitive to changes in illumination, the effect is very visible when the intensity of the different groups are changed dynamically, as a human observer clearly will see such effect.

Figure 13:
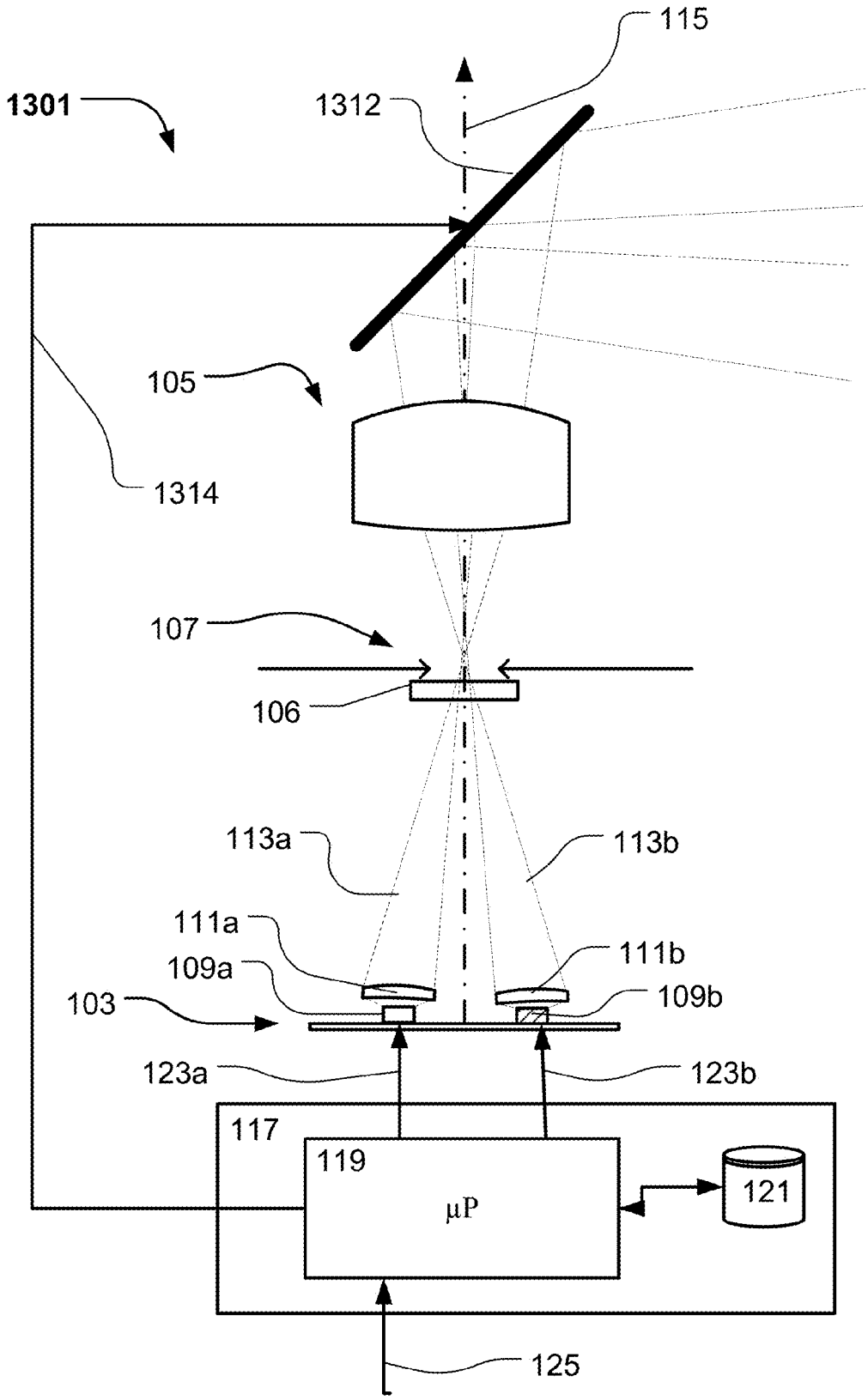
FIG. 13 illustrates a structural diagram of another embodiment of a projecting light fixture according to the present invention.

FIG. 13 illustrates a structural diagram of another projecting light fixture 1301 according to the present invention and where the projecting system comprises a scanning mirror 1312. The projecting light fixture 1301 is similar to the projecting light fixture 101 illustrated in FIG. 1 and similar features as been labeled with the same reference numbers will not be described in further details. In this embodiment, the projecting light fixture 1301 comprises a scanning mirror 1312 which are configured to reflect the projected light in relation to the primary optical axis 115. The scanning mirror 1312 can for instance be movable by a number of actuators (not shown) and the actuators can be configured to rotate the scanning mirror in relation to the primary optical axis and/or tilt the scanning mirror in relation to the primary optical axis whereby the direction of the reflected light beams can be controlled. The controller can be configured to control the movement of the scanning mirror through a communication line 1314 as known in the art of entertainment optical scanners. Additionally, the controller can be configured to coordinate the movement of the scanning mirror in relation to the intensity of the first illumination and the second illumination. As a result, further light effect can be created. One advantage of using a scanning mirror is the fact that the direction of the projected light can be changed very fast.

What is claimed is:

1. A projecting light fixture comprising:

a light source module comprising a plurality of light sources and a plurality of light collectors, the plurality of light collectors collect light from at least one of the plurality of light sources and convert the collected light into a source light beam, the source light beam propagates at least partially along a primary optical axis;

a projecting system positioned along the primary optical axis, the projecting system collects a part of the light generated by the plurality of light sources, and the projecting system projects the collected light along the primary optical axis; and an optical gate positioned between the light source module and the projecting system, where at least one beam shaping object is arranged near the optical gate;

wherein the plurality of light sources and the plurality of light collectors are arranged in:

a first group comprising at least one first light source and at least one first light collector, the at least one first light collector collects light from the at least one first light source and converts the collected light into at least one first source light beam; the at least one first source light beam provides a first illumination of the at least one beam shaping object; and a second group comprising at least one second light source and at least one second light collector, the at least one second light collector collects light from the at least one second light source and converts the collected light into a second source light beam; the second source light beam provides a second illumination of the at least one beam shaping object;

wherein the first illumination and the second illumination are different and where the projecting light fixture comprises at least one controller configured to vary an intensity of the first light source and an intensity of the second light source in relation to each other, and wherein the at least one beam shaping object is movable in relation to the at least one first source light beam and the second source light beam and in that the controller is configured to coordinate the movement of the at least one beam shaping object in relation to varying the intensity of the at least one first light source and intensity of the at least one second light source in relation to each other.

2. The projecting light fixture according to claim 1 wherein the controller is configured to vary the intensity of the at least one first light source and the intensity of the at least one second light source in relation to each other based on at least one intensity function.

3. The projecting light fixture according to claim 1 wherein the controller is configured to alternately turn the at least one first light source and the at least one second light source on and off in relation to each other, such that the at least one first light source is turned on when the at least one second light source is turned off and the at least one first light source is turned off when the at least one second light source is turned on.

4. The projecting light fixture according to claim 1 wherein the first illumination and the second illumination are different in that an angle between the primary optical axis and the at least one first source light beam and an angle between the primary optical axes and the second source light beam are different.

5. The projecting light fixture according to claim 4 wherein the angle between the primary optical axis and the at least one first source light beam is smaller than a lower angle limit, and where the angle between the primary optical axis and the second source light beam is larger than the lower angle limit.

6. The projecting light fixture according to claim 1 wherein the first illumination and the second illumination are different in that the at least one first light source beam and the second light source beam illuminate different areas of the at least one beam shaping object.

7. The projecting light fixture according to claim 1 wherein the first illumination and the second illumination are different in that at the at least one beam shaping object and a light distribution of the light originating from the at least one first light source is different from a light distribution of light originating from the at least one second light source.

8. The projecting light fixture according to claim 1 wherein the light collector comprises an enhancing optical component that is movable between a non-enhancing position and an enhancing position, wherein the enhancing position and the enhancing optical component enhances a difference between the first illumination and the second illumination.

9. The projecting light fixture according to claim 1 wherein the light collector comprises a minimizing optical component that is movable between a non-minimizing position and a minimizing position, wherein the minimizing position and the minimizing optical component minimizes a difference between the first illumination and the second illumination.

10. The projecting light fixture according to claim 1 wherein the light fixture comprises at least one light modifying component that is movable in relation to the source light beams and can be arranged in a partial position in relation to the source light beam, where the light modifying component in the partial position is arranged at least partially in at least the at least one first source light beam and is arranged outside the second source light beam.

11. The projecting light fixture according to claim 1 wherein the projecting light fixture comprises a prism rotatable in relation to the at least one first source light beam and the second source light beam, and in that the at least one controller is configured to coordinate a rotation of the prism in relation to varying an intensity of the at least one first light source and an intensity of the at least one second light source in relation to each other.

12. The projecting light fixture according to claim 1 wherein the at least one beam shaping object comprises a textured glass gobo comprising a plurality of refractive elements.

13. The projecting fixture according to claim 1 wherein the plurality of light sources and the plurality of light collectors are arranged in a positive number of additional groups, where each of the additional groups comprises at least one light source and at least one light collector, the at least one light collector collects light from the at least one light source and converts the collected light into an additional source light beam; the additional source light beam provides an additional illumination of the at least one beam shaping object; wherein each of the additional illuminations are different and wherein the controller is configured to control an intensity of the at least one first light source and the at least one second light source and each of the additional light sources in relation to each other in a coordinated manner.

14. A projecting light fixture comprising:

a light source module comprising a plurality of light sources and a plurality of light collectors, the plurality of light collectors collect light from at least one of the plurality of light sources and convert the collected light into a source light beam, the source light beam propagates at least partially along a primary optical axis; the plurality of light sources and the plurality of light collectors are arranged in:

a first group comprising at least one first light source and at least one first light collector, the at least one first light collector collects light from the at least one first light source and converts the collected light into at least one first source light beam; the at least one first source light beam provides a first illumination of the beam shaping object;

a second group comprising at least one second light source and at least one second light collector, the at least one second light collector collects light from the at least one second light source and converts the collected light into a second light beam; the second source light beam provides a second illumination of the beam shaping object;

a projecting system positioned along the primary optical axis, the projecting system collects a part of the light generated by the plurality of light sources, the projecting system projects the collected light along the primary optical axis;

an optical gate positioned between the light source module and the projecting system, where at least one beam shaping object are arranged near the optical gate;

wherein the first illumination and the second illumination are different and where the projecting light fixture comprises at least one controller configured to control the at least one first light source and the at least one second light source individually, the projecting light fixture comprises at least one of:

an enhancing optical component, that is movable between a non-enhancing position and an enhancing position, wherein the enhancing position the enhancing optical component enhances a difference between the first illumination and the second illumination; and a minimizing optical component that is movable between a non-minimizing position and a minimizing position, wherein the minimizing position and the minimizing optical component minimizes the difference between the first illumination and the second illumination.

15. A projecting light fixture comprising:

a light source module comprising a plurality of light sources and a plurality of light collectors, the plurality of light collectors collect light from at least one of the plurality of light sources and convert the collected light into a source light beam, the source light beam propagates at least partially along a primary optical axis;

a projecting system positioned along the primary optical axis, the projecting system collects a part of the light generated by the plurality of light sources, and the projecting system projects the collected light along the primary optical axis; and an optical gate positioned between the light source module and the projecting system, where at least one beam shaping object is arranged near the optical gate;

wherein the plurality of light sources and the plurality of light collectors are arranged in:

a first group comprising at least one first light source and at least one first light collector, the at least one first light collector collects light from the at least one first light source and converts the collected light into at least one first source light beam; the at least one first source light beam provides a first illumination of the at least one beam shaping object; and a second group comprising at least one second light source and at least one second light collector, the at least one second light collector collects light from the at least one second light source and converts the collected light into a second source light beam; the second source light beam provides a second illumination of the at least one beam shaping object;

wherein the first illumination and the second illumination are different and where the projecting light fixture comprises at least one controller configured to vary an intensity of the first light source and an intensity of the second light source in relation to each other; and wherein the first illumination and the second illumination are different in that the at least one first light source beam and the second light source beam illuminate different areas of the at least one beam shaping object.

16. A projecting light fixture comprising:

a light source module comprising a plurality of light sources and a plurality of light collectors, the plurality of light collectors collect light from at least one of the plurality of light sources and convert the collected light into a source light beam, the source light beam propagates at least partially along a primary optical axis;

a projecting system positioned along the primary optical axis, the projecting system collects a part of the light generated by the plurality of light sources, and the projecting system projects the collected light along the primary optical axis; and an optical gate positioned between the light source module and the projecting system, where at least one beam shaping object is arranged near the optical gate;

wherein the plurality of light sources and the plurality of light collectors are arranged in:

a first group comprising at least one first light source and at least one first light collector, the at least one first light collector collects light from the at least one first light source and converts the collected light into at least one first source light beam; the at least one first source light beam provides a first illumination of the at least one beam shaping object; and a second group comprising at least one second light source and at least one second light collector, the at least one second light collector collects light from the at least one second light source and converts the collected light into a second source light beam; the second source light beam provides a second illumination of the at least one beam shaping object;

wherein the first illumination and the second illumination are different and where the projecting light fixture comprises at least one controller configured to vary an intensity of the first light source and an intensity of the second light source in relation to each other; and wherein the light collector comprises an enhancing optical component that is movable between a non-enhancing position and an enhancing position, wherein the enhancing position and the enhancing optical component enhances a difference between the first illumination and the second illumination.

17. A projecting light fixture comprising:

a light source module comprising a plurality of light sources and a plurality of light collectors, the plurality of light collectors collect light from at least one of the plurality of light sources and convert the collected light into a source light beam, the source light beam propagates at least partially along a primary optical axis;

a projecting system positioned along the primary optical axis, the projecting system collects a part of the light generated by the plurality of light sources, and the projecting system projects the collected light along the primary optical axis; and an optical gate positioned between the light source module and the projecting system, where at least one beam shaping object is arranged near the optical gate;

wherein the plurality of light sources and the plurality of light collectors are arranged in:

a first group comprising at least one first light source and at least one first light collector, the at least one first light collector collects light from the at least one first light source and converts the collected light into at least one first source light beam; the at least one first source light beam provides a first illumination of the at least one beam shaping object; and a second group comprising at least one second light source and at least one second light collector, the at least one second light collector collects light from the at least one second light source and converts the collected light into a second source light beam; the second source light beam provides a second illumination of the at least one beam shaping object;

wherein the first illumination and the second illumination are different and where the projecting light fixture comprises at least one controller configured to vary an intensity of the first light source and an intensity of the second light source in relation to each other; and wherein the light collector comprises a minimizing optical component that is movable between a non-minimizing position and a minimizing position, wherein the minimizing position and the minimizing optical component minimizes a difference between the first illumination and the second illumination.

18. A projecting light fixture comprising:

a light source module comprising a plurality of light sources and a plurality of light collectors, the plurality of light collectors collect light from at least one of the plurality of light sources and convert the collected light into a source light beam, the source light beam propagates at least partially along a primary optical axis;

a projecting system positioned along the primary optical axis, the projecting system collects a part of the light generated by the plurality of light sources, and the projecting system projects the collected light along the primary optical axis; and an optical gate positioned between the light source module and the projecting system, where at least one beam shaping object is arranged near the optical gate;

wherein the plurality of light sources and the plurality of light collectors are arranged in:

a first group comprising at least one first light source and at least one first light collector, the at least one first light collector collects light from the at least one first light source and converts the collected light into at least one first source light beam; the at least one first source light beam provides a first illumination of the at least one beam shaping object; and a second group comprising at least one second light source and at least one second light collector, the at least one second light collector collects light from the at least one second light source and converts the collected light into a second source light beam; the second source light beam provides a second illumination of the at least one beam shaping object;

wherein the first illumination and the second illumination are different and where the projecting light fixture comprises at least one controller configured to vary an intensity of the first light source and an intensity of the second light source in relation to each other; and wherein the light fixture comprises at least one light modifying component that is movable in relation to the source light beams and can be arranged in a partial position in relation to the source light beam, where the light modifying component in the partial position is arranged at least partially in at least the at least one first source light beam and is arranged outside the second source light beam.

19. A projecting light fixture comprising:

a light source module comprising a plurality of light sources and a plurality of light collectors, the plurality of light collectors collect light from at least one of the plurality of light sources and convert the collected light into a source light beam, the source light beam propagates at least partially along a primary optical axis;

a projecting system positioned along the primary optical axis, the projecting system collects a part of the light generated by the plurality of light sources, and the projecting system projects the collected light along the primary optical axis; and an optical gate positioned between the light source module and the projecting system, where at least one beam shaping object is arranged near the optical gate;

wherein the plurality of light sources and the plurality of light collectors are arranged in:

a first group comprising at least one first light source and at least one first light collector, the at least one first light collector collects light from the at least one first light source and converts the collected light into at least one first source light beam; the at least one first source light beam provides a first illumination of the at least one beam shaping object; and a second group comprising at least one second light source and at least one second light collector, the at least one second light collector collects light from the at least one second light source and converts the collected light into a second source light beam; the second source light beam provides a second illumination of the at least one beam shaping object;

wherein the first illumination and the second illumination are different and where the projecting light fixture comprises at least one controller configured to vary an intensity of the first light source and an intensity of the second light source in relation to each other; and wherein the projecting light fixture comprises a prism rotatable in relation to the at least one first source light beam and the second source light beam, and in that the at least one controller is configured to coordinate a rotation of the prism in relation to varying an intensity of the at least one first light source and an intensity of the at least one second light source in relation to each other.

* * * * *